United States Patent [19]

Conklin, Jr.

[11] Patent Number: 4,674,386

[45] Date of Patent: Jun. 23, 1987

[54] AUGMENTED BASS HAMMER STRIKING DISTANCE FOR PIANOS

[75] Inventor: Harold A. Conklin, Jr., Cincinnati, Ohio

[73] Assignee: Baldwin Piano & Organ Company, Loveland, Ohio

[21] Appl. No.: 747,807

[22] Filed: Jun. 21, 1985

[51] Int. Cl.[4] ..... G10C 3/00

[52] U.S. Cl. ..... 84/216; 84/199; 84/221

[58] Field of Search ..... 84/184–188, 84/216, 221, 234, 236–240, 174, 197, 199, 189

[56] References Cited

U.S. PATENT DOCUMENTS 3,096,675 7/1963 Graves ..... 84/237
4,478,125 10/1984 Rodriguez ..... 84/212

OTHER PUBLICATIONS

McFerrin, "The Piano—its Acoustics", Tuners Supply Co., Boston, 1972, p. 84.
Brinsmead, "The History of the Pianoforte", reissued by Singing Tree Press, Detroit, 1969, p. 47.
Good, "Giraffes, Black Dragons, and Other Pianos", Stanford University Press, 1982, p. 9.
White, "Piano Tuning and Allied Arts", Tuners Supply Co., Boston, 5th Ed., 1946, p. 45.
Helnholtz, "Sensations of Tone as a Physiological Basic for the Theory of Music", Dover Pub., Inc., N.Y., 1954, p. 77.
Hansing, "Das Pianoforte in Seinen Akustischen Anlagen", New York, 1888, p. 92.
Young, "Inharmonicity of Plain Wire Piano Strings", JASA, vol. 24, May 1952, p. 267.
Wolfenden, "A Treatise on the Art of Pianoforte Constructions", reprinted by Unwin Bros., Ltd, 1975, pp. 50–51.
Briggs, "Pianos, Pianists and Sonics", Wharfdale Wireless Works, Bradford, Yorks, 1951, p. 37.
Harding, "The Piano-Forte", reprinted by Da Capo Press, New York, 1973, p. 64.
Vant, "Piano Scale Making", Pub. by Albert B. Vant, New York, 1927, p. 30.
Wood, "The Physics of Music", Methuen & Co., Ltd., London, 1944, p. 94.
Ortmann, "The Physical Basis of Piano Touch and Tone", E. P. Dutton & Co., New York, 1925, p. 96.
Marcuse, "Musical Instruments, A Comprehensive Dictionary", W. W. Norton & Co., Inc., New York, 1975, p. 405.
White, "Theory and Practice of Piano-Forte Building", Edward Lyman Bill, Pub, N.Y., Foreword Dtd 1909, p. 34.

*Primary Examiner*—Benjamin R. Fuller
*Attorney, Agent, or Firm*—Frost & Jacobs

[57] ABSTRACT

An augmented bass hammer striking distance is provided in both upright and grand pianos. At least those strings in the bass section having an optimum striking distance (d) to speaking length (L) ratio (d/L) of a value greater than 1/7 have their hammers located at a striking distance (d) along their lengths as determined by their optimum d/L value. The hammers of all of the bass section strings can be so located. Alternatively, the hammers of those bass section strings having an optimum value of d/L of 1/7 or less can be conventionally located at the same striking distance (d) determined from a preselected d/L value falling within the range of 1/7 to 1/9, or can be incrementally varied. When the lowest few strings of the bass section appear to have subjectively less apparent fullness of tone, the striking distance of the lowest few strings can be shortened string-by-string toward the low end of the bass section by amounts which will modify their subjective d/L - dependent pitch in 100-cent increments. When it is desired to have a rapid and smooth transition from a first group of strings in the bass region having d/L values greater than 1/7 to a second group of strings in the bass section having d/L values of 1/7 or less, the highest few strings of the first group can have their striking distances (d) shortened string-by-string toward the high end of the bass section by amounts which will modify their subjective d/L - dependent pitch in 100-cent increments.

12 Claims, 23 Drawing Figures

AUGMENTED BASS HAMMER STRIKING DISTANCE FOR PIANOS

TECHNICAL FIELD

The invention relates to pianos having a bass section wherein at least some strings have a striking distance (d) to speaking length (L) ratio (d/L) in excess of 1/7.

BACKGROUND ART

The present invention is directed to mechano-acoustic pianos of the type having tone-generating elements in the form of struck strings made of steel core wire stretched under tension. The strings are either plain or wrapped with one or more layers of covering wire, each layer encircling the core wire in the form of a multi-turn helix. The piano has 88 notes, a key for each note, a hammer for each note and a compass spanning at least the frequency range from the note AO=27.5 Hz to the note C8=4186 Hz.

According to references describing the history and early development of the piano and its forerunners, the earliest designers of keyboard instruments were unaware of the importance of the relationship between the striking distance (d) and the speaking length (L) for each string. The striking distance of each string is that distance from the string plate vibrational termination of the string to the point at which the hammer hits it. The speaking length of each string is its length between its vibrational terminations. This relationship can be expressed as the ratio d/L. Consequently, this relationship was ignored or disregarded in the instruments the early designers built. This fact is verified in William Braid White, *Theory and Practice of Pianoforte Building* (New York: Edward Lyman Bill, circa 1909), p. 34 and Rosamond E. M. Harding, *The Pianoforte* (New York: Da Capo Press, 1973; original publication 1933), p. 64. In due time, however, it was discovered that the value of d/L influences profoundly the performance of the instrument, and efforts were made to produce instruments in which the value of d/L was set within the range considered to produce optimum performance. According to abundant references in the literature the optimum value for d/L in pianos is universally believed to lie within the range between 1/7 and 1/9. That is, it was concluded and has been accepted for a very long time that pianos sound best when the hammers strike the strings at a point between 1/7 and 1/9 of their speaking length. (Decimally, this range is approximately 0.143–0.111.) This range is discussed in numerous publications of which the following are exemplary: W. V. McFerrin, *The Piano—Its Acoustics* (Boston: Turners Supply Co., 1972), p. 19; Edgar Brinsmead, *The History of the Pianoforte,* (Detroit: Singing Tree Press, 1969; original publication London: Ewer and Co., 1879), p. 47; Edwin M. Good, *Giraffes, Black Dragons, and Other Pianos* (Palo Alto: Stanford University Press, 1982), p. 9; Otto Ortman, *The Physical Basis of Piano Touch and Tone* (New York: Dutton and Co. 1925), p. 96. That this belief is carried out in the acatual practice of manufacturing pianos is confirmed by inspection of various instruments. In contemporary pianos built according to the prior art, the only known exception to the 1/7 to 1/9 rule occurs in the extreme treble of the instrument, where, in order to produce maximum sound output, it has been found to be necssary to reduce d/L to a value smaller than 1/9. Values as small as 1/20 (0.05 if expressed decimally) have been found to be required. But this practice also is familiar to all piano designers, and is accepted as a standard design practice.

The present invention is based upon the discovery that the tone quality of the bass portion of the scale of some pianos can be improved by increasing the value of d/L of at least some of the notes to a value greater than 1/7. The findings are that values of d/L between 1/7 and 1/5 produce the best results. It also has been determined that the optimum value of d/L depends upon the frequency of the particular note in question and also upon the design parameters of each particular string. This finding is in contrast to conventional prior art design procedure in which it is normally considered desirable to design the entire bass portion of the scale so as to have the same value of d/L for all of the bass strings. In contrast to this standard practice, it has been found that in order for each note to have the best tone quality, it is desirable to determine the optimum value of d/L for each string individually. The optimum values found for the strings of adjacent notes on the scale generally will not be very much different from each other, but will seldom be exactly the same. In addition, it has been determined that the optimum value of d/L depends on the parameters of the string such as its length, its tension, the sizes of wire used to fabricate the string, and on the resulting inherent inharmonicity of the string. In general, the optimum value of d/L for a particular note on the scale will increase as the size of the instrument decreases. That is, small pianos with their shorter strings will require larger values of d/L than larger pianos. This appears to result from the greater inharmonicity of the shorter strings. To give an idea of the amount of this difference by numerical example, it has been found in one case that a No. 1 string of speaking length 210.3 cm for a large grand piano, tuned to a freqeuncy of 27.5 Hz, required a d/L of 0.158 for optimum tone, while a No. 1 string 122.2 cm long, for an upright piano of medium size, tuned to the same frequency, required a d/L of approximately 0.172 for optimum results.

The phrase "bass portion" as used herein and in the claims refers to those notes of the scale, the strings of which terminate on the bass bridge. The number of strings which terminate on the bass bridge of a piano varies considerably depending upon the nature of the piano. Generally, the number of such strings falls within the range of from about 17 strings to about 32 strings.

DISCLOSURE OF THE INVENTION

According to the present invention an augmented bass hammer striking distance is provided for pianos. The present invention is applicable both to upright and grand pianos.

At least those strings in the bass section having an optimum striking distance (d) to speaking length (L) ratio (d/L) of a value greater than 1/7 have their hammers located at a striking distance (d) along their lengths as determined by their optimum d/L values. In one embodiment of the invention, the hammers of all of the strings of the bass section can be so located. In fact, all of the hammers of the piano could be so located.

In a second embodiment of the invention, only the hammers of those strings of the bass section having an optimum d/L ratio greater than 1/7 are so located. The remaining strings of the bass section having an optimum d/L value of 1/7 or less have their hammers conventionally located at the same striking distance (d) determined from a preselected d/L value falling within the range of 1/7 to 1/9.

In a third embodiment the hammers of those strings of the bass section having an optimum d/L ratio greater than 1/7 are so located. The remaining strings of the bass section having an optimum d/L value of 1/7 or less are varied incrementally from key to keyboard key, depending upon their length, design and inharmonicity, to create a blend between those strings having a d/L ratio greater than 1/7 and the strings of the treble bridge. This blending or incremental change can be continued partway for some of the strings of the treble bridge.

Should the lowest few strings of the bass section appear to have subjectively less apparent fullness of tone, they may have their striking distances (d) shortened string-by-string toward the low end of the bass section by amounts which will modify their subjective d/L-dependent pitch in 100-cent increments.

When it is desired to have a rapid and smooth transition from a first group of strings in the bass section (having d/L values greater than 1/7) to a second group of strings in the bass section (having d/L values of 1/7 or less), the highest few strings of the first group can have their striking distances (d) shortened string-by-string toward the high end of the bass section by amounts which will modify their subjective d/L-dependent pitch in 100-cent increments.

DETAILED DESCRIPTION OF THE INVENTION

For purposes of an exemplary showing, the invention will be described in its application to an upright piano. This is not intended as a limitation, and it will be understood that the present invention is equally applicable to a grand piano.

Figure 1A:
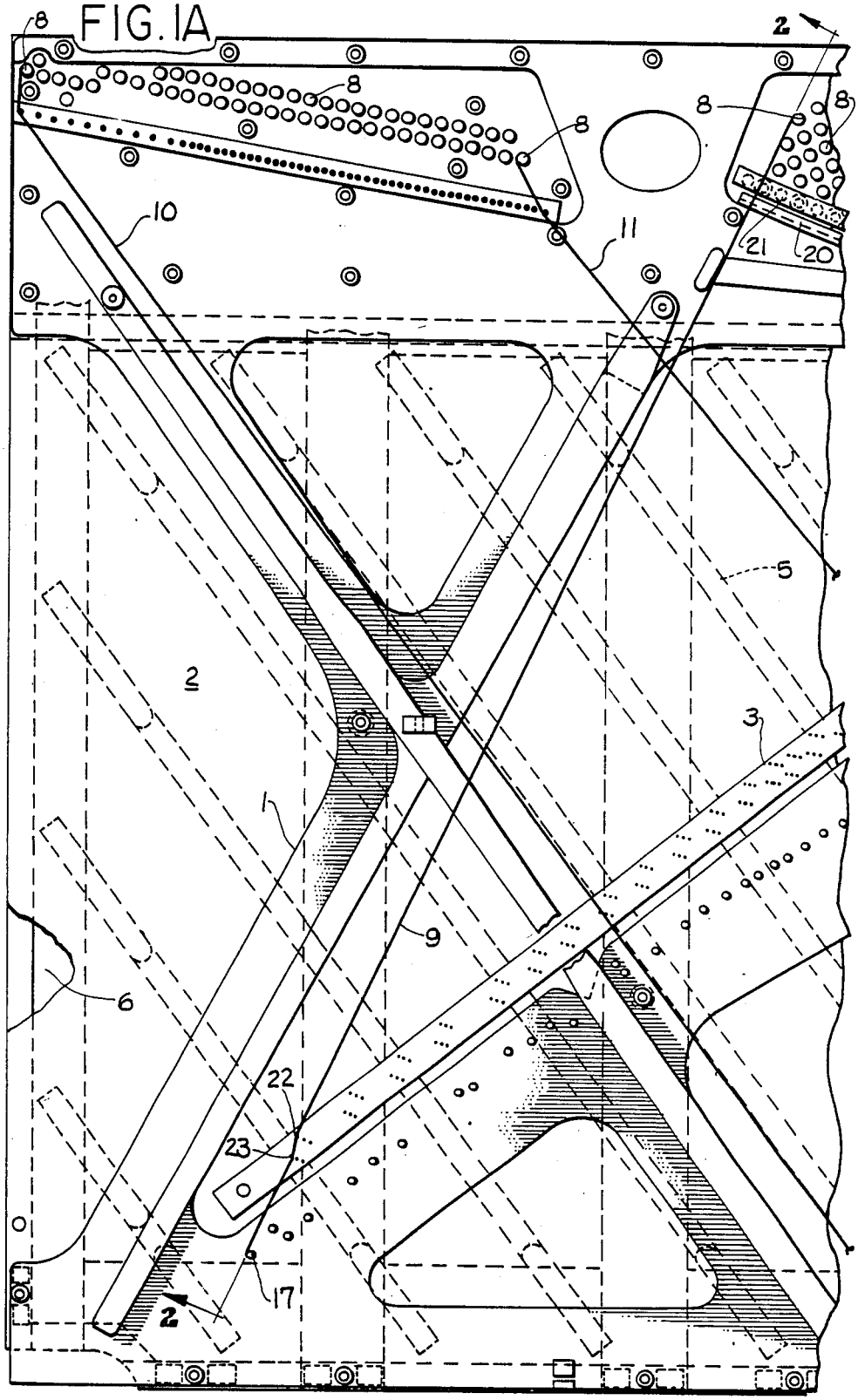
FIGS. 1A and 1B constitute a front elevational view of the string plate, soundboard and back of an upright piano.
Figure 1B:
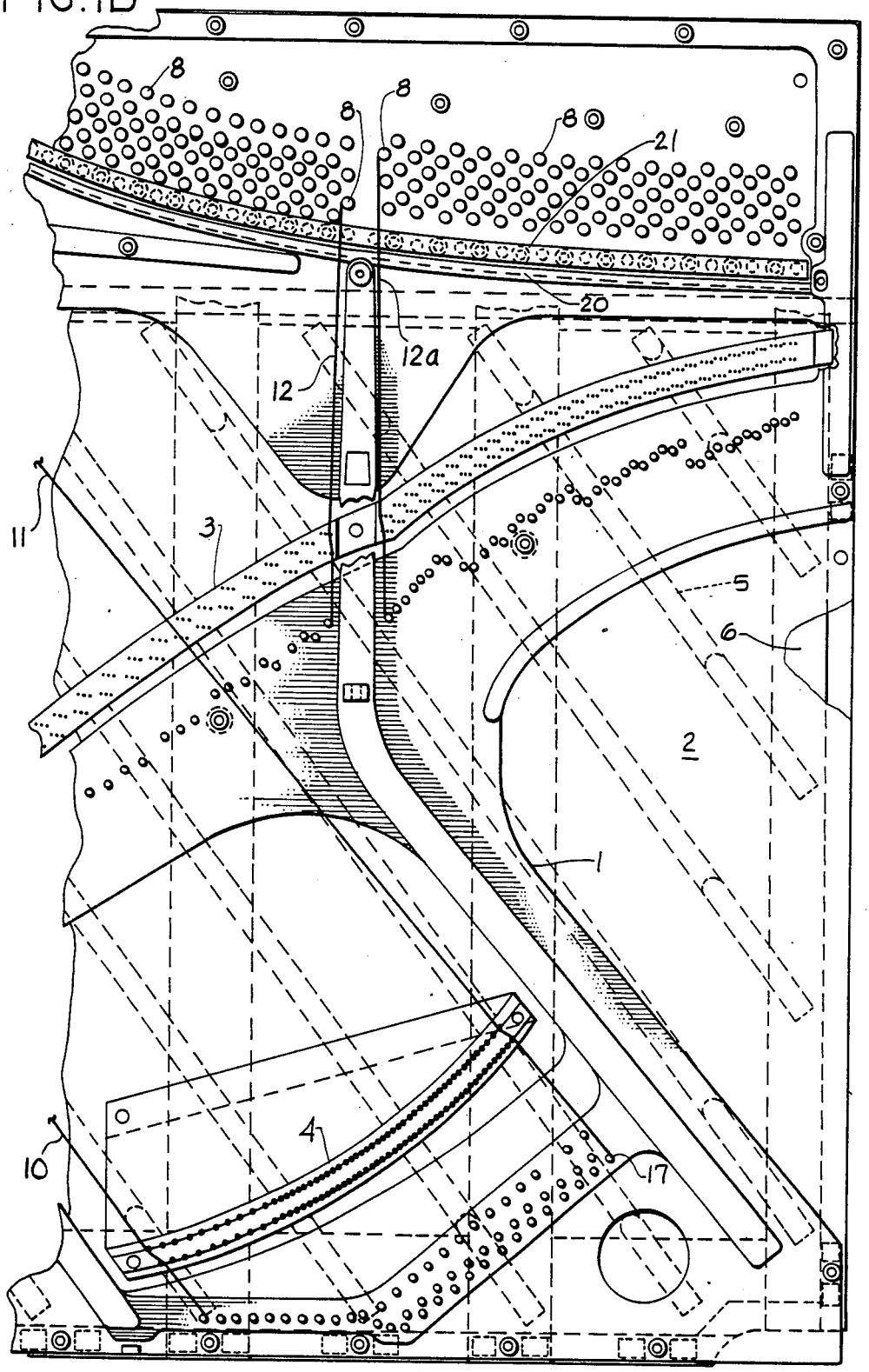

FIGS. 1A and 1B show a front elevational view of the interior of an upright piano, the major parts of which may be identified as follows: The string plate or "plate" is shown at 1. In most cases this is a gray iron casting. The string plate must be strong enough to support with stability the load imposed on it by the combined tension of all of the piano strings. At 2 is indicated the soundboard of the piano, with its treble and bass bridges shown at 3 and 4, respectively. The soundboard vibrates in response to the strings and radiates sound as a result of this vibration. The soundboard usually is made of a light but strong softwood such as spruce and is reinforced by a plurality of diagonally extending ribs 5 on its rearward face. The soundboard bridges 3 and 4, normally of hardwood such as maple, are attached to the soundboard with an adhesive. Each of the strings makes contact with one of the two bridges 3 and 4 by a means which permits a transfer of the vibrational energy of the string through its respective bridge to the soundboard.

The soundboard is attached at its edges to a heavy wooden framework known as the "back". Attachment is made by gluing with an adhesive. The back is indicated at 6. Its structure is not clearly visible in FIGS. 1A and 1B because it is obscured by the soundboard and plate. The back 6 is more clearly shown in FIG. 2. At the top of the back is a "pin block" 7. This is a heavy wooden panel having holes into which the tuning pins 8 of the piano are driven. Each string has its own tuning pin 8. Each string is attached to its tuning pin by being wrapped around the pin approximately three turns. Slipping is prevented because the extreme end of the string is inserted into a hole in the tuning pin which is only slightly larger in diameter than the diameter of the string. After the strings are installed in the piano, their tension is adjusted by turning the tuning pins with a special wrench. Some of the strings of the piano are indicated at 9, 10, 11, 12 and **12*a* in FIGS. 1A and 1B**. The remaining strings have been deleted for purposes of clarity.

Figure 2:
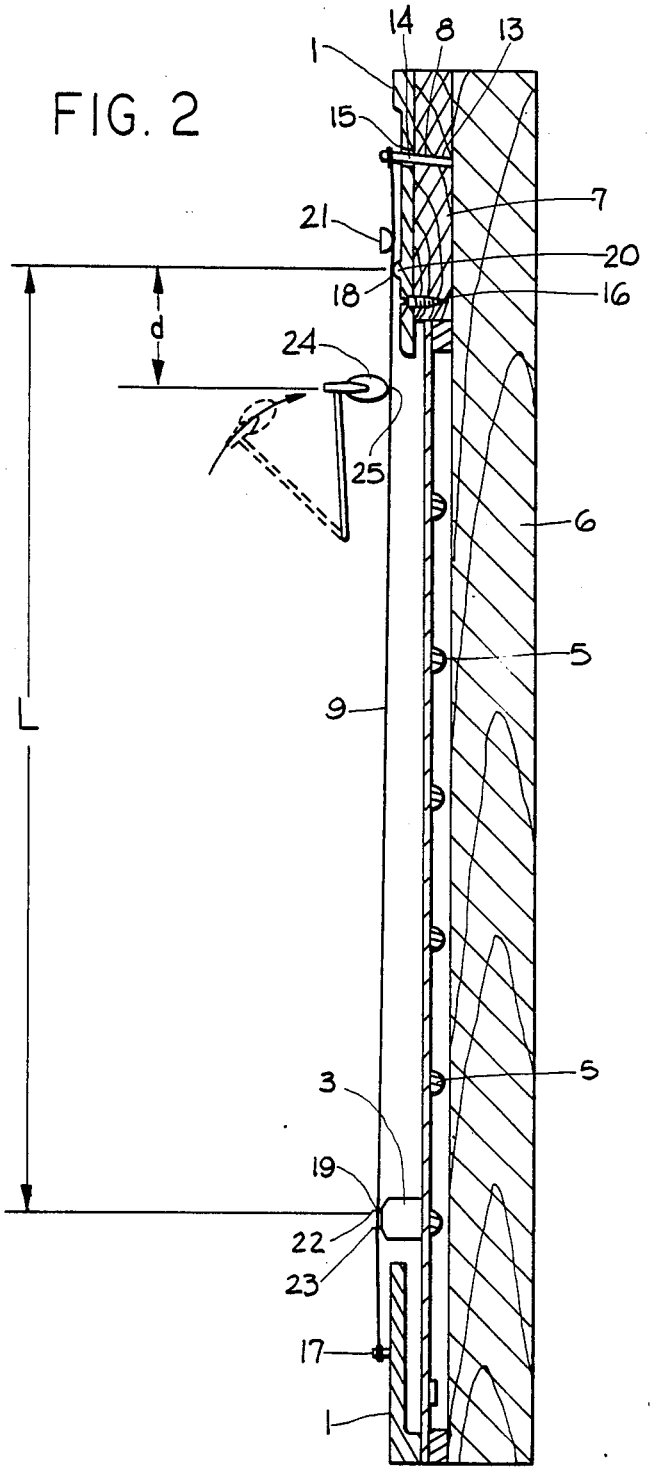
FIG. 2 is a simplified cross sectional view taken along section line 2—2 of FIG. 1A.

FIG. 2 shows a simplified cross sectional view of the piano, taken along the section line 2—2 in FIG. 1A, adjacent and parallel to string 9. In this view it is made clearer just how the strings are attached within the instrument. At the top of the figure is shown a tuning pin 8 with the string 9 wrapped around it. The tuning pin 8 has been driven into its hole 13 in the pin block 7, the hole 13 being almost the same diameter as the pin, so that friction between the pin 8 and the surrounding wood will prevent the pin from turning by itself, which would release the tension of string 9. The tuning pin 8 also passes through a hole 14 in the string plate 1, and through a wooden bushing, 15, which is fitted tightly into hole 14. The string plate 1 is fastened tightly to the piano back by means of a plurality of screws, one of which is shown at 16. The plate 1 is much better able to resist the tension of the strings than is the back 6, because the plate is made of iron, while the back is of wood. The purpose of the wooden bushing 15 is to transmit the downward force on the tuning pin 8 (due to the tension of the attached string 9) directly to the plate 1, so that the wooden back 6 is not required to withstand the tension load of the string.

As is true of all of the strings, the lower extreme end of string 9 is anchored to a metal "hitch pin" such as shown at 17, which is driven into a tightly fitting hole in the string plate 1. Although the opposite extreme ends of the string are located respectively at the tuning pin 8 and the hitch pin 17, very little vibration of the string exists at either of these points. Instead, the principal vibration of the string takes place along its "speaking length." The speaking length of the string of FIG. 2 is that length between points 18 and 19 on the figure. Point 18 is a V-shaped ridge 20 cast into the plate 1. Between the ridge 20 and the tuning pin 8, the string is deflected by a "pressure bar", shown at 21. The pressure bar 21 is attached to the plate 1 and the back 6 by means of several screws (not shown) which are tightened during the assembly of the instrument, pulling the pressure bar 21 down toward the plate 1, thereby deflecting the string 9. It is this deflection of the string 9 at point 18 on V-shaped ridge 20 which prevents that portion of the string between the ridge 20 and the tuning pin 8 from vibrating when the instrument is played. Thus the upper end of the speaking length of the string 9 is defined by the contact point 18 of the string 9 with this V-shaped ridge 20. The lower termination of the speaking length occurs at one of the bridges, in this instance bridge 3. The string 9 is terminated vibrationally at the bridge 3 by being deflected around a pair of nail-like metal "bridgepins" 22 and 23 which are driven into the bridge 3. The point of contact 19 of the string 9 with the upper bridgepin 22, defines the lower end of the speaking length of the string. The numerical value of this speaking length will be represented in subsequent discussion by the letter L. The numerical value, L, is used in calculating the tension and other characteristics of the vibrating string 9.

When the keys of a piano are depressed by the pianist's fingers, the strings of the piano are struck and excited into vibration by felt-covered hammers. Intermediate between each piano key and its corresponding hammer is an "action" (not shown), consisting of a well known system of levers and pivots. This mechanism is designed to cause each hammer, such as hammer 24 of FIG. 2, to accelerate from rest and to strike its string when its key is played. After the hammer 24 strikes the string 9 it immediately rebounds and is caught and held away from the string 9 at an intermediate "check" position by another part of the action, until its respective key is released. Then the hammer 24 returns to its rest position until the next time its key is played.

Referring again to FIG. 2, an element very important to this invention is the distance labeled d, which is the distance along the string from the string plate vibrational string termination 18 to the point 25 at which the hammer 24 strikes the string 9. This distance will be known herein as the striking distance, d. The relation between the striking distance d and the speaking length of the string, L, is also most important to this invention. This relation can be described mathematically by the fraction d/L. d/L expresses the ratio of the striking distance of the hammer divided by the speaking length of the string. In a piano, this ratio affects significantly the tone of the instrument, and has been regarded as important by every knowledgeable designer of pianos for a long time.

In order to understand how the tone quality of a piano is affected by the d/L at which its hammers strike the strings, it is necessary to understand in what manner a piano string vibrates when it is struck. Physicists have long known that the vibrations of a struck string are formed by a series of waves which propagate along the string. In strings of finite length having well defined end points, such as those in a piano, when the propagating waves reach either end of the string they are reflected and travel back again toward the opposite end of the string. If the frictional losses of the string and its associated supporting structure are low enough, long-lasting vibrations will occur, and "standing waves" of vibration will be set up along the string. If the vibration has been initiated by a sharp blow such as from a piano hammer, the string will vibrate simultaneously at several of its natural frequencies. These frequencies will be approximately harmonics (integral multiples) of the smallest or fundamental string natural frequency. Actual strings such as piano strings always have some stiffness due to the properties of the material from which they are made, and consequently the natural frequencies of piano strings will not be exactly harmonically related in frequency. Because the word "harmonic" implies that the natural frequencies are exactly integral multiples of the fundamental frequency, piano strings are said to have "partials" rather than harmonics. Each partial will have a frequency somewhat greater than the value for a harmonic. This non-harmonic character of the natural frequencies of a struck vibrating string is termed "inharmonicity." This is discussed, for example, in Robert W. Young, "INHARMONICITY OF PLAIN WIRE PIANO STRINGS", *Journal of the Acoustical Society of America*, Vol. 24, May, 1952, p. 267. The propagation of vibrations aloing a string can be represented mathematically, and such mathematical representations are common in the technical literature of physics. See Philip M. Morse, "VIBRATION AND SOUND", (New York: McGraw-Hill Book Co., Inc., 1948).

Figure 3:
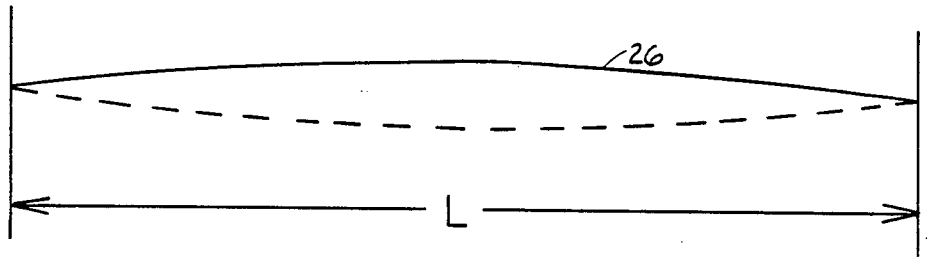
FIGS. 3, 4 and 5 are diagrammatic representations of a piano string vibrating at its first partial (or fundamental), second partial and third partial, respectively.
Figure 4:
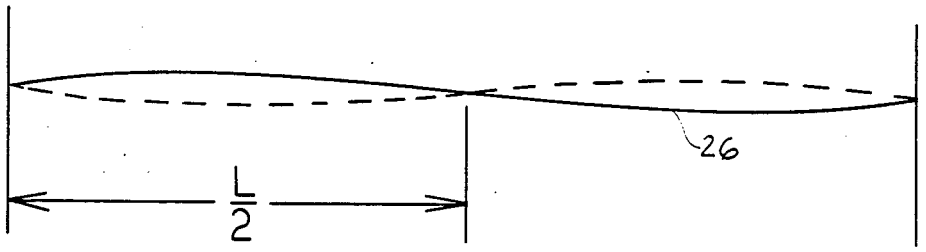
Figure 5:
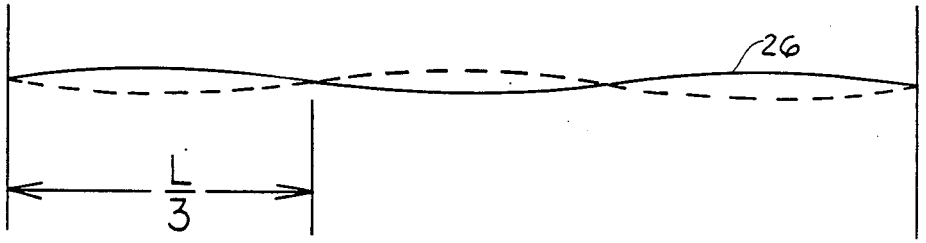

FIGS. 3, 4 and 5 illustrate a piano string 26 vibrating at its first partial (fundamental), and at its second and third partials, respectively. The lines representing the string are drawn to indicate the positions of the string at its condition of maximum deflection for each of the partials shown. As is indicated by FIGS. 3 and 4, the deflection of the vibrating string will be greatest at its center if it is vibrating at its fundamental frequency, and will be minimum at the center when vibration occurs at the second partial. In this latter case, the deflections of the string will be maximum at a distance very nearly L/4 from either end. FIG. 5 indicates that minimum vibration at the third partial frequency occurs at a distance L/3 from either end. It is basic to an understanding of stringed instruments such as pianos that the quality of tone produced depends upon the relative deflection or amplitude of string vibration at the various partial frequencies. To cite some extreme examples, an instrument producing a superabundance of high-numbered partials would tend to sound overly brilliant or perhaps harsh in tone, while an instrument lacking in high order partials would tend to sound muffled in tone. This is well known to those knowledgeable in acoustics. Likewise, if the relative amplitude of the partials remains the same but if the amplitude of all is increased, then the resulting tone will become louder.

Modern electronic equipment has greatly facilitated the analysis of musical tones. One important tool for tonal analysis is the spectrum analyzer. This device can accept an elecrical signal such as the amplified output of a microphone or other pickup device placed near to or on a musical instrument, and can place into memory and analyze a timewise portion of the tone of the instrument. The results of such an analysis can be displayed in the form of a graph on which the frequency of a partial is indicated by its position along the abscissa or X-axis, and the amplitude of the partial is indicated by the amount of deflection in the ordinate or Y direction. FIGS. 6, 7, 8 and 9 show the results of such a spectrum analysis of a struck piano string which was not in a piano, but was mounted on a metal frame. The frame was used so that the analysis would reflect only the results due to the string itself and would not include any variations in frequency due to the soundboard or other parts of a complete piano. The vibration of the string was picked up by a piezoelectric transducer located at one end of the speaking length of the string. This transducer was able to generate an electrical voltage approximately proportional to the amplitude of the partials of the vibrating string. The string under analysis was a string having L=210.3 cm and a fundamental frequency of approximately 27.5 Hz. This is the frequency of the note of lowest pitch on a standard 88-note piano. The graphs display the spectral components within the frequency range 0–800 Hz.

Figure 6:
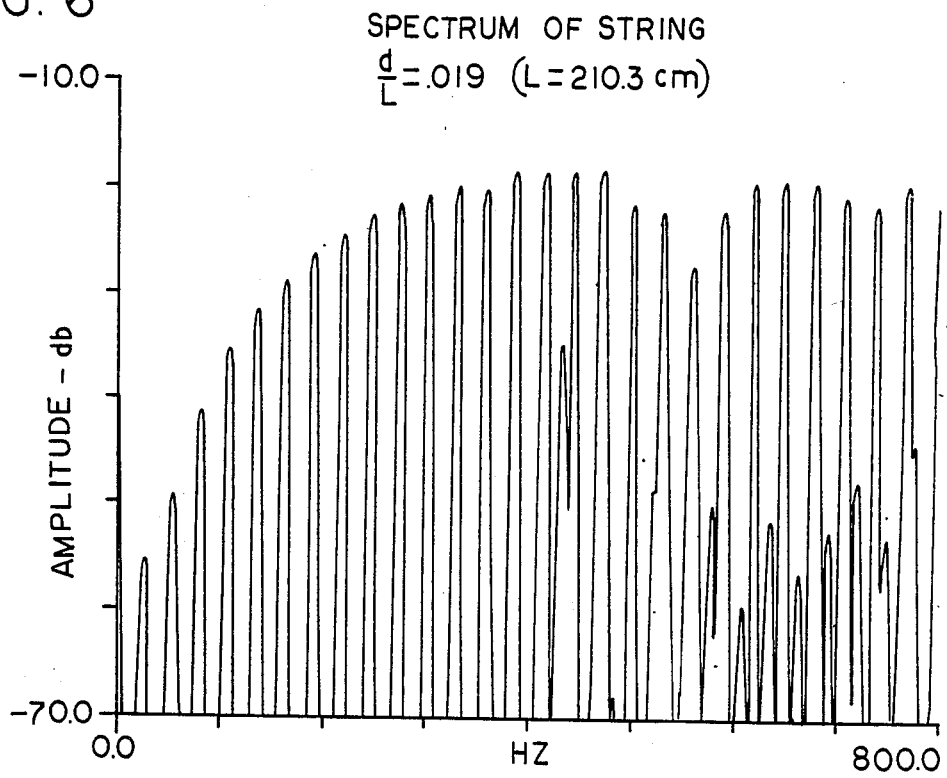
FIGS. 6 through 9 are graphs illustrating the spectrum of a string struck at various striking distances.
Figure 7:
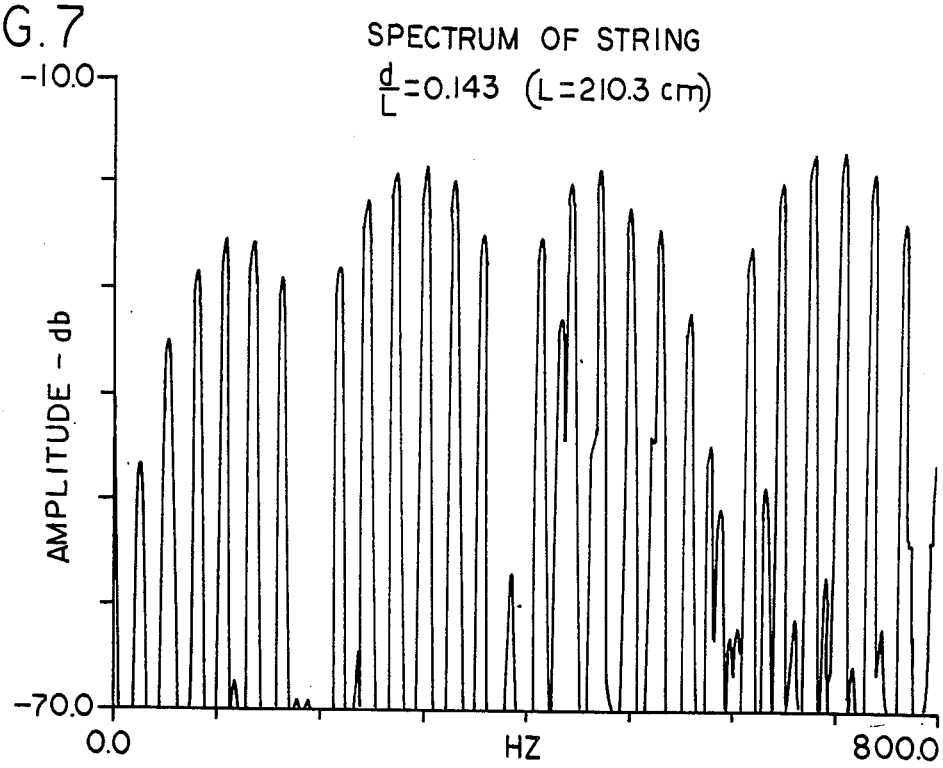
Figure 8:
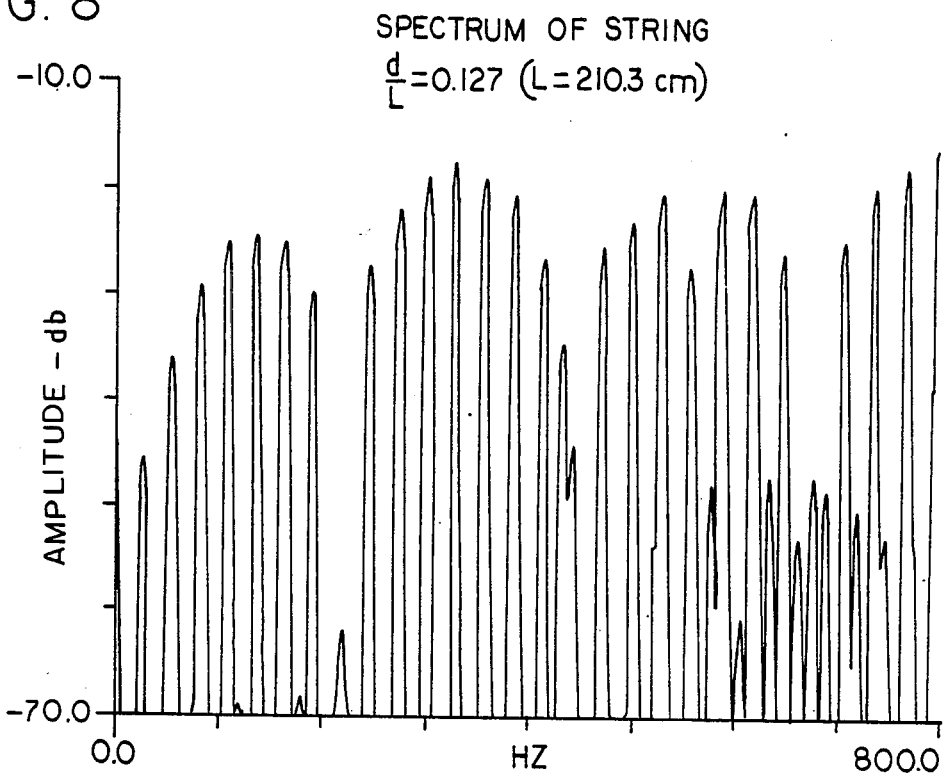
Figure 9:
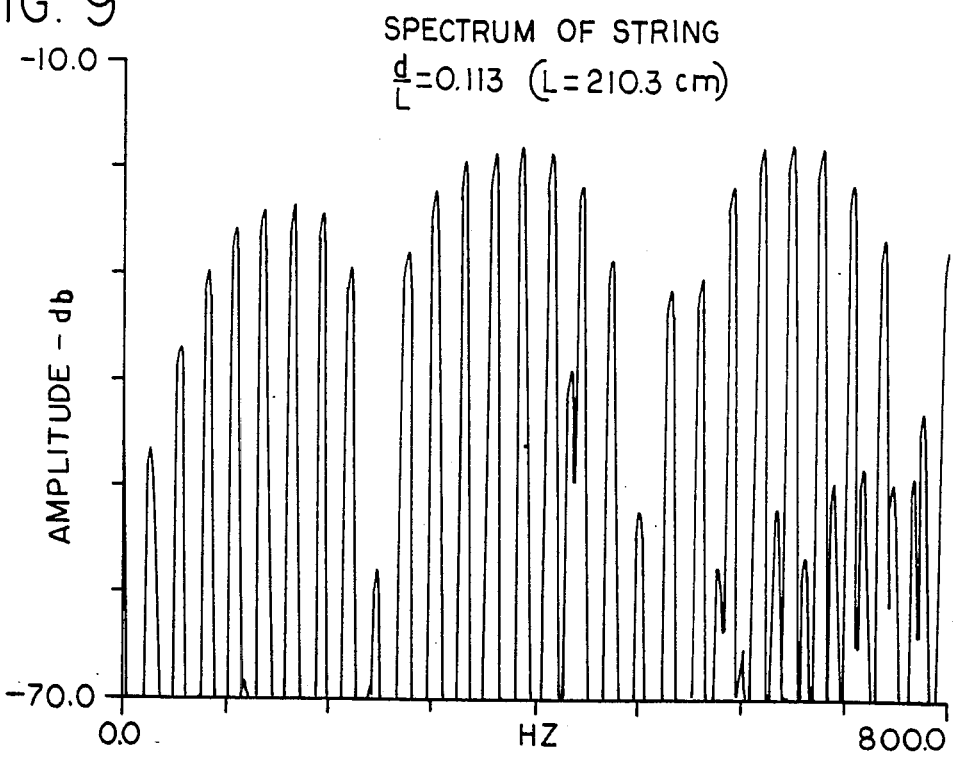
Figure 10:
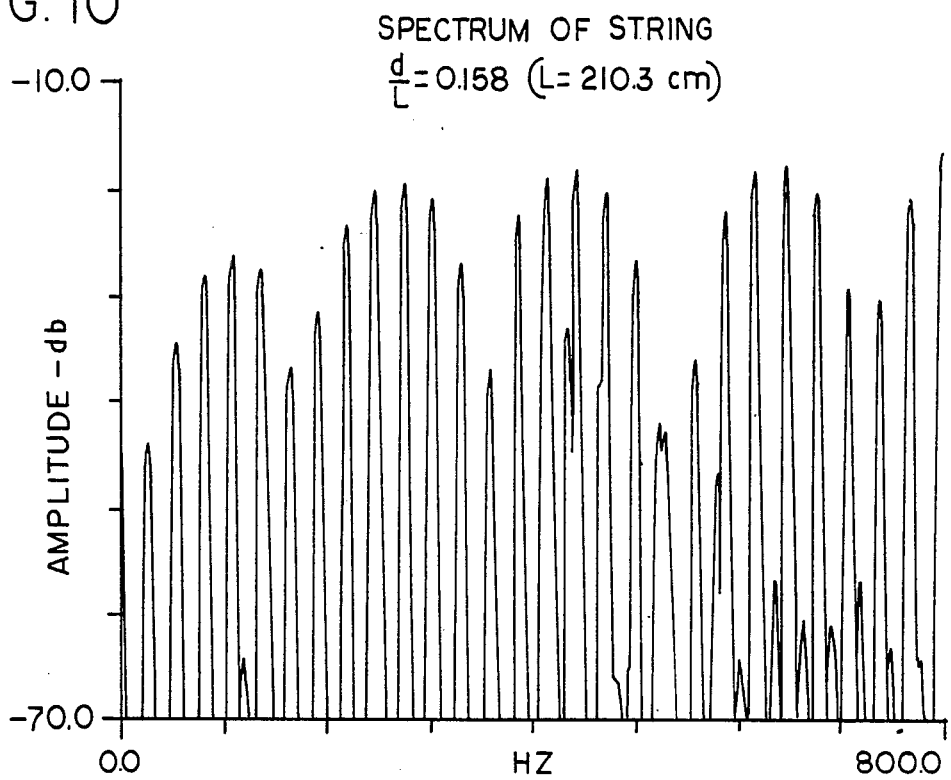
FIGS. 10 through 13 are graphs illustrating the optimum spectrum for various strings.

FIG. 6 shows the spectrum of this string when it was struck quite close (d=4 cm) to one end of the speaking length. It will be seen that within this 0–800 Hz. frequency range the amplitude of the partials tends to increase gradually up to a frequency of about 400 Hz., above which the partials tend to have reasonably constant amplitude. FIG. 7 shows the spectrum of this same string when it was struck at a value of d equal to approximately 1/7 of the speaking length. The strength of the hammer blow was kept constant by a mechanical striking device. It will be observed that the amplitude of the 7th partial has a very small value, and that the amplitude of the other partials varies rather irregularly as the frequency increases. FIGS. 8 and 9, respectively, show the spectrum of this same string when it was struck at ⅛ and 1/9 of its speaking length. It can be seen that the 8th and 9th partials, respectively, were greatly attenuated, and that each figure shows a different characteristic shape of the envelope formed by the relative amplitude of the various partials. It will be shown later that the amplitude of the fundamental or first, second, third and fourth partials increases with an increase in the value of d/L. When the tone of the string was heard through a loudspeaker (by amplifying the output voltage of the aforementioned piezoelectric transducer), it was obvious that there were distinct differences in the quality of the tone at each of these striking distances. FIGS. 7 and 9 show the spectra obtained at almost exactly each of the limits of d/L between which, according to the prior art (as indicated by the previously cited references), the best tone quality was supposed to occur. However, when the striking distance was increased to a specific value that was greater than L/7, an improved quality of tone was obtained that was judged by listeners to be better and more desirable than the quality obtained for values of d/L within the conventional 1/7–1/9 range. FIG. 10 shows the spectrum of this string at what was considered to be the optimum striking distance, which was, approximately, d=33.2 cm (d/L=0.158). At this value of d the sound of the string, as heard through the loudspeaker, took on a quality of tone that caused the listener to conclude that this was the "best" place for striking the string. At this value of d, the sound seemed to have maximum consonance, and the sensation of the pitch of the string was reinforced. When the striking distance was varied in either direction along the string from this "optimum" value, listeners agreed that the quality of tone became different and less desirable.

It has been known that striking a string at L/9, L/8, and L/7 will attenuate, respectively, the 9th, 8th, and 7th partials. However, it is believed to be a new and useful finding that an improvement in tone quality can be obtained outside the L/7 to L/9 range previously considered to be optimum. When this same string was tested in a complete piano by varying d/L, the value of d/L found to produce the best tone quality was the same as that found for the string as tested above.

Figure 11:
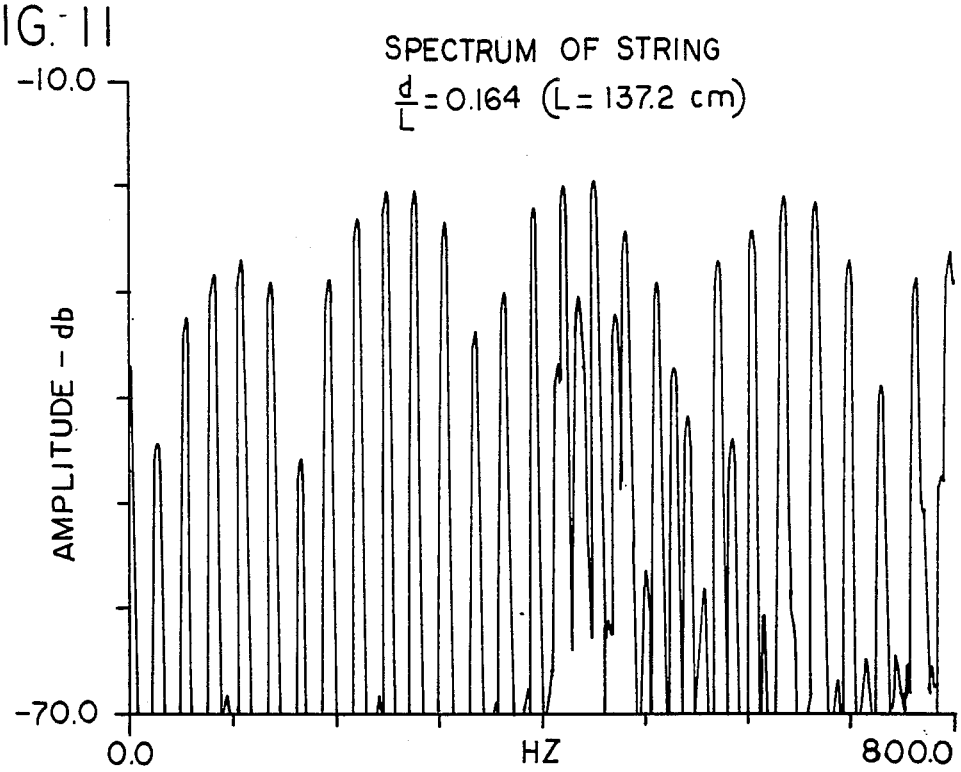

FIG. 11 shows the "optimum" spectrum for a shorter string having a speaking length of 137.2 cm (54.0 inches) and the same fundamental frequency as before (27.5 Hz.). This is the longest, lowest pitched string from a much smaller piano. The same identical piano hammer was used to test this string. It was determined by listening that the value d=22.5 cm gave the preferred quality of tone. By calculation, this d gives an optimum d/L of 0.164, which is approximately L/6.

Figure 12:
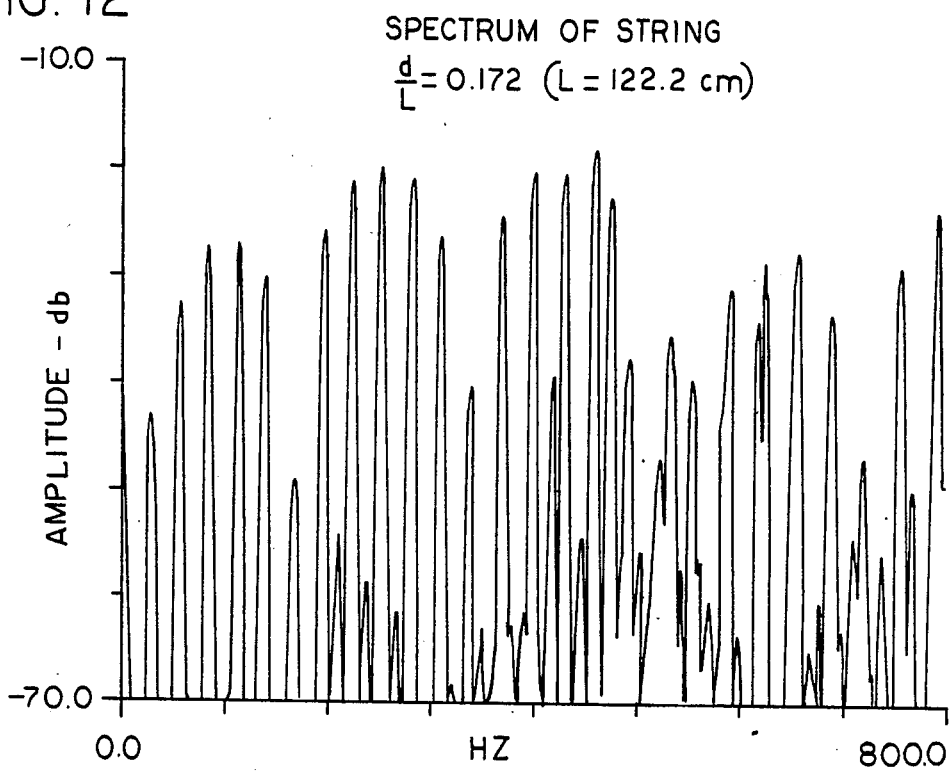

FIG. 12 shows the "optimum" spectrum of a still shorter string having a speaking length of 122.2 cm (48.1 inches) and the same fundamental frequency (27.5 Hz.). The optimum value of d for this string was found to be about 21 cm, giving a d/L of approximately 0.172 when tested with the same hammer that was used for the other strings. The head of this hammer had a weight of approximately 8.3 grams, a value typical for hammers used in the bass portion of the scale of the instrument. However, experiments were made to find the effect of making the hammer either lighter or heavier, and it was found that an increase or decrease in weight of approximately plus or minus 20% did not result in any significant change in the optimum value of d/L.

Upon inspection of FIGS. 10, 11 and 12, it will be seen that there is a strong similarity in the shape of these three spectra which represent "optimum" hammer striking distances for three different piano strings having the same fundamental frequency but different speaking lengths. However, it will also be apparent that these three spectra are by no means identical. In other words, it would not be correct to conclude that in the general case the optimum striking point for any string can be found by varying d/L until the resulting spectrum matches a prespecified standard. But it can be said that the d/L for "optimum" tone quality was for each of these strings well outside of the 1/7 to 1/9 range (1/7=0.143, 1/9=0.111) held by the prior art to be optimum.

Figure 13:
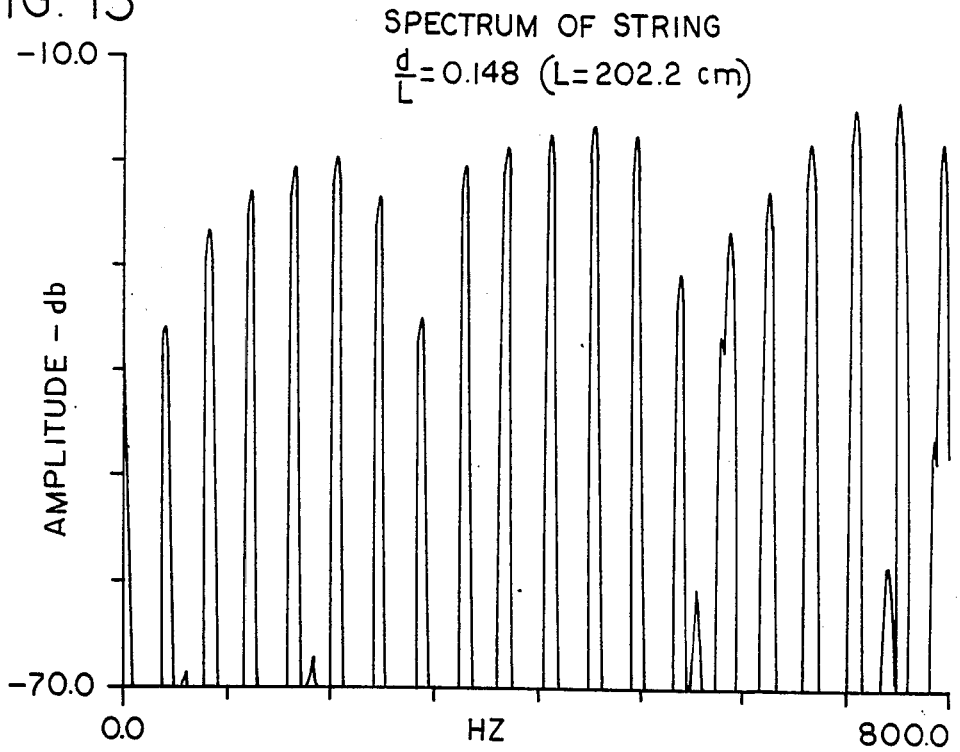
Figure 14:
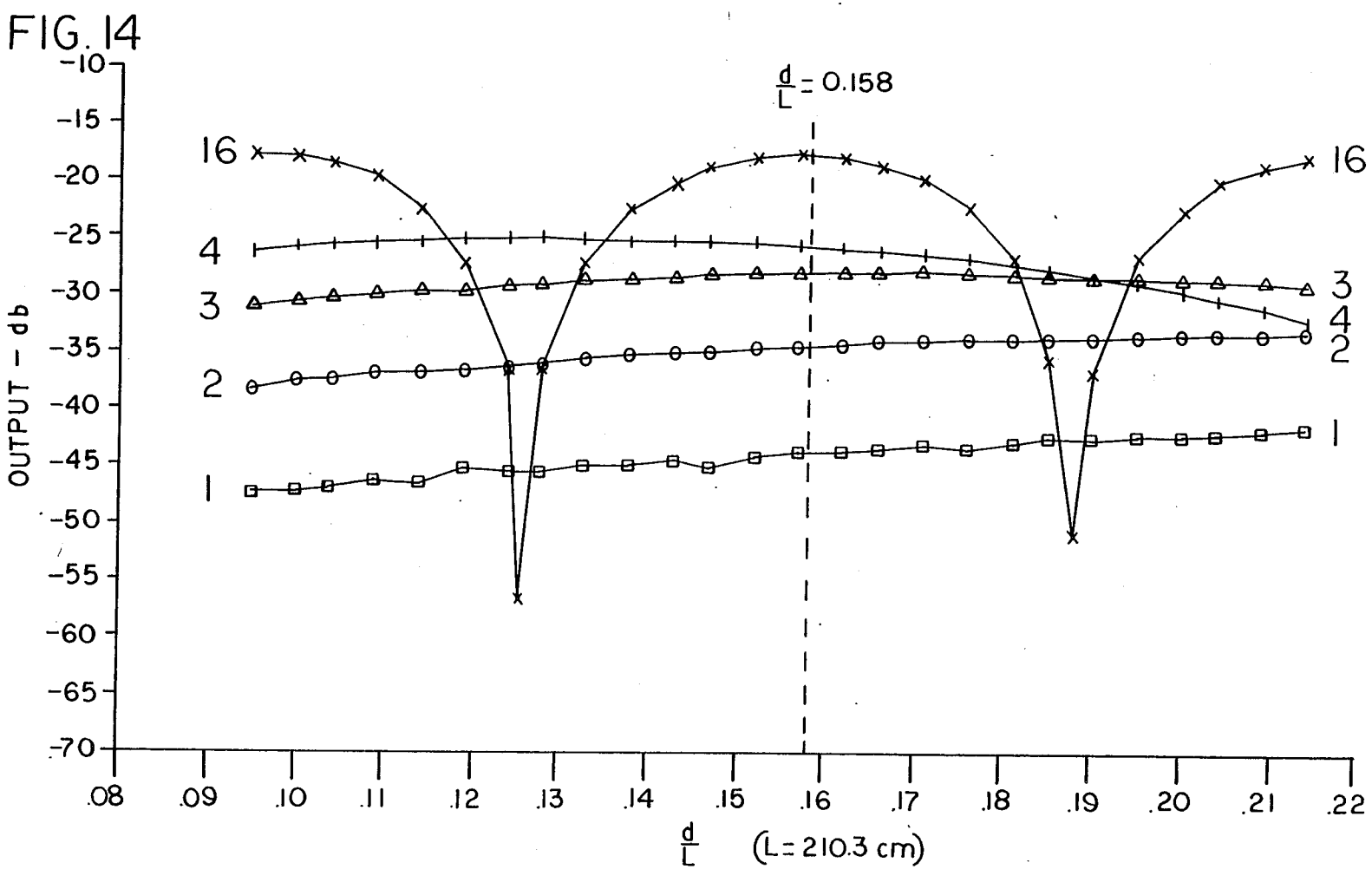
FIGS. 14 and 15 are graphs showing the variation of the relative amplitude of partials 1 through 9 and 16 as a function of d/L for the string of FIG. 10.
Figure 15:
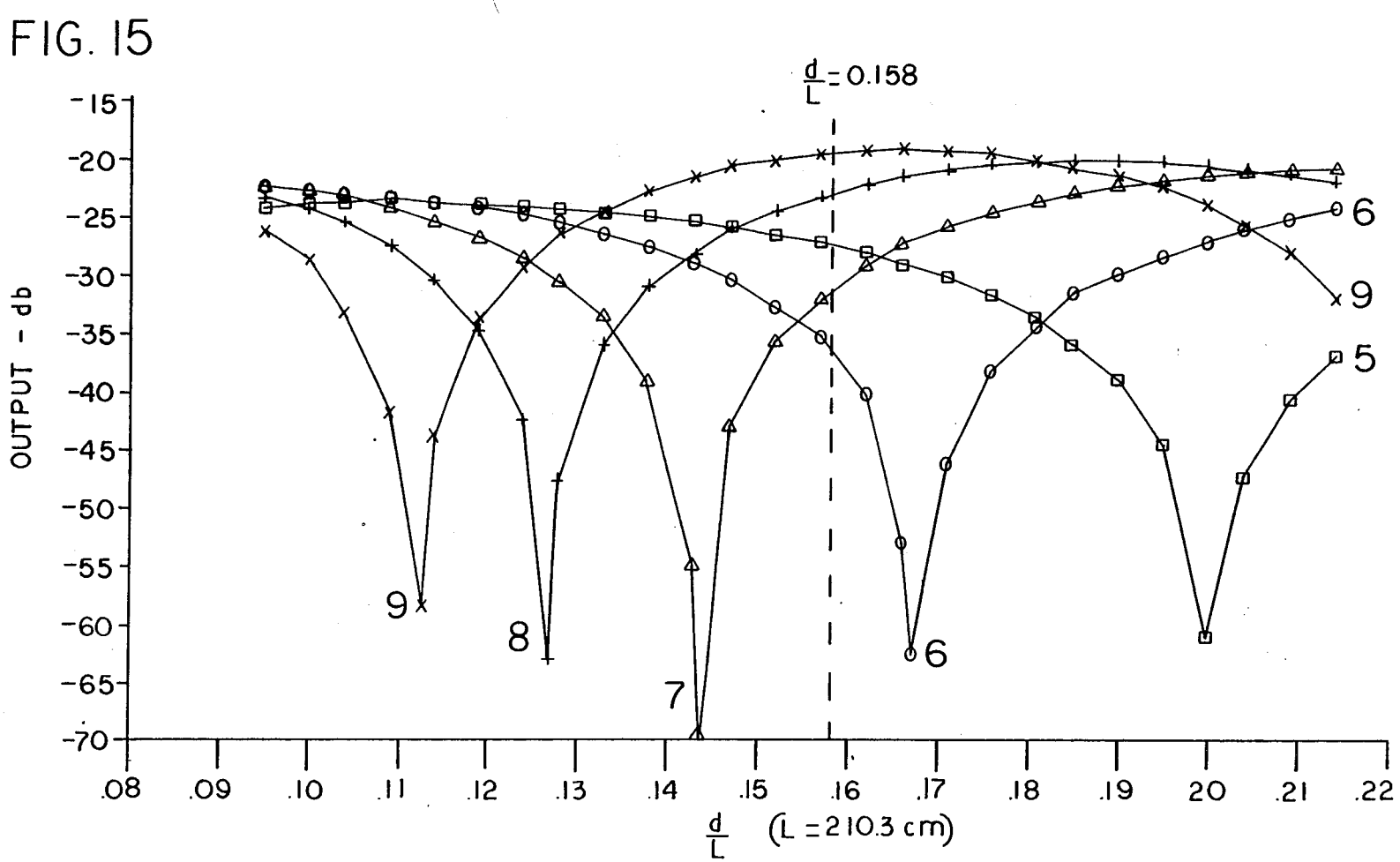
Figure 16:
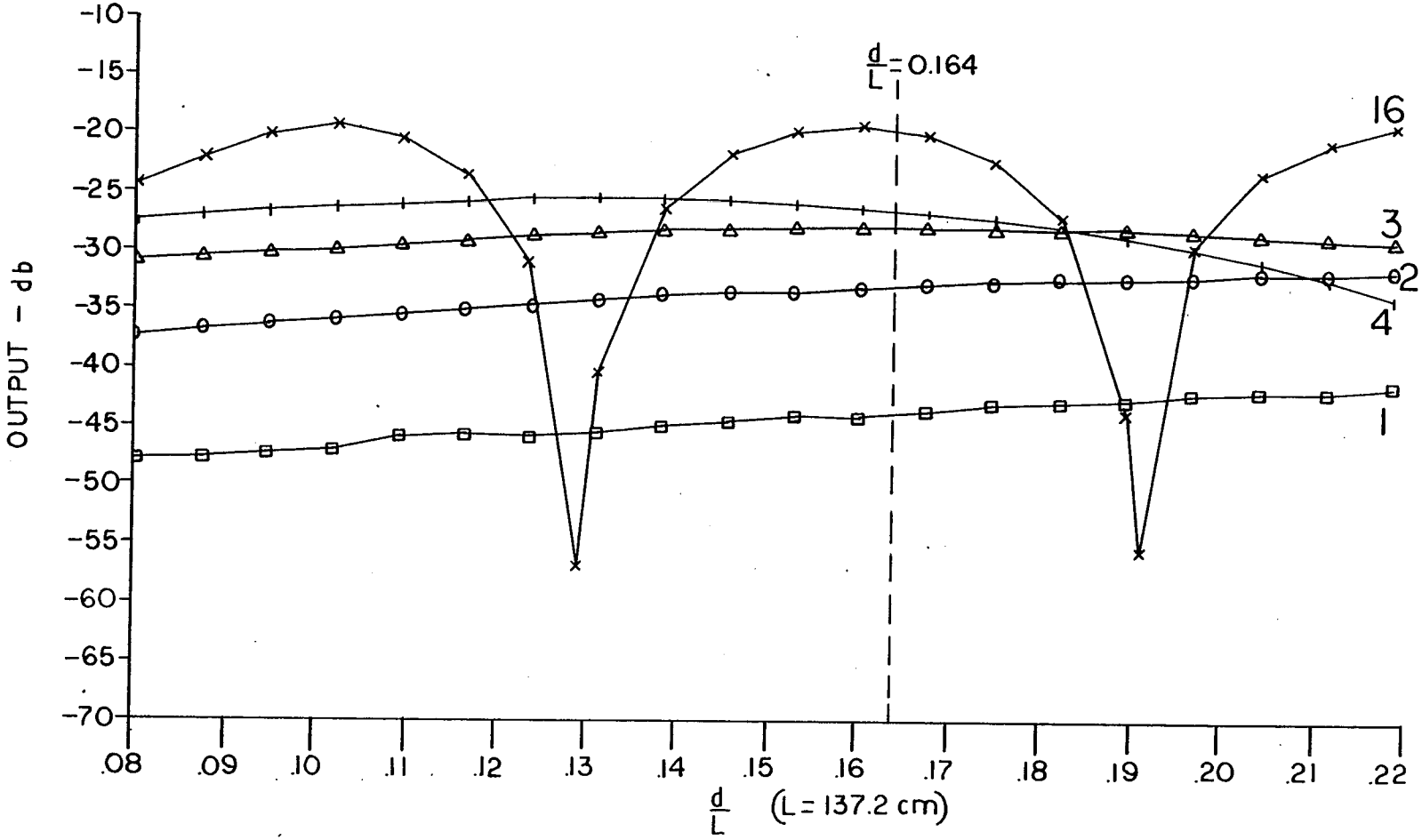
FIGS. 16 and 17 are graphs showing the variation of the relative amplitude of partials 1 through 9 and 16 as a function of d/L for the string of FIG. 11.
Figure 17:
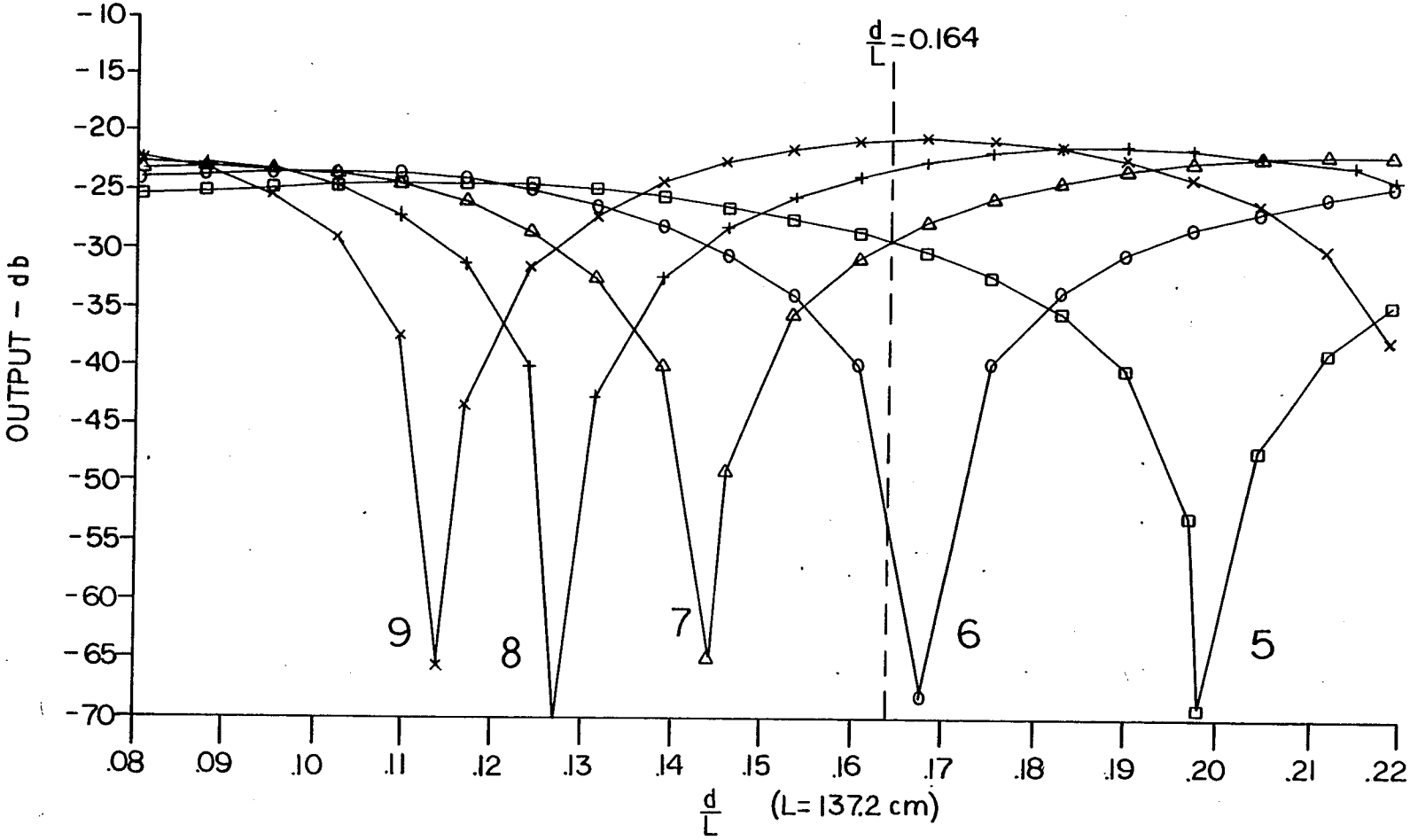
Figure 18:
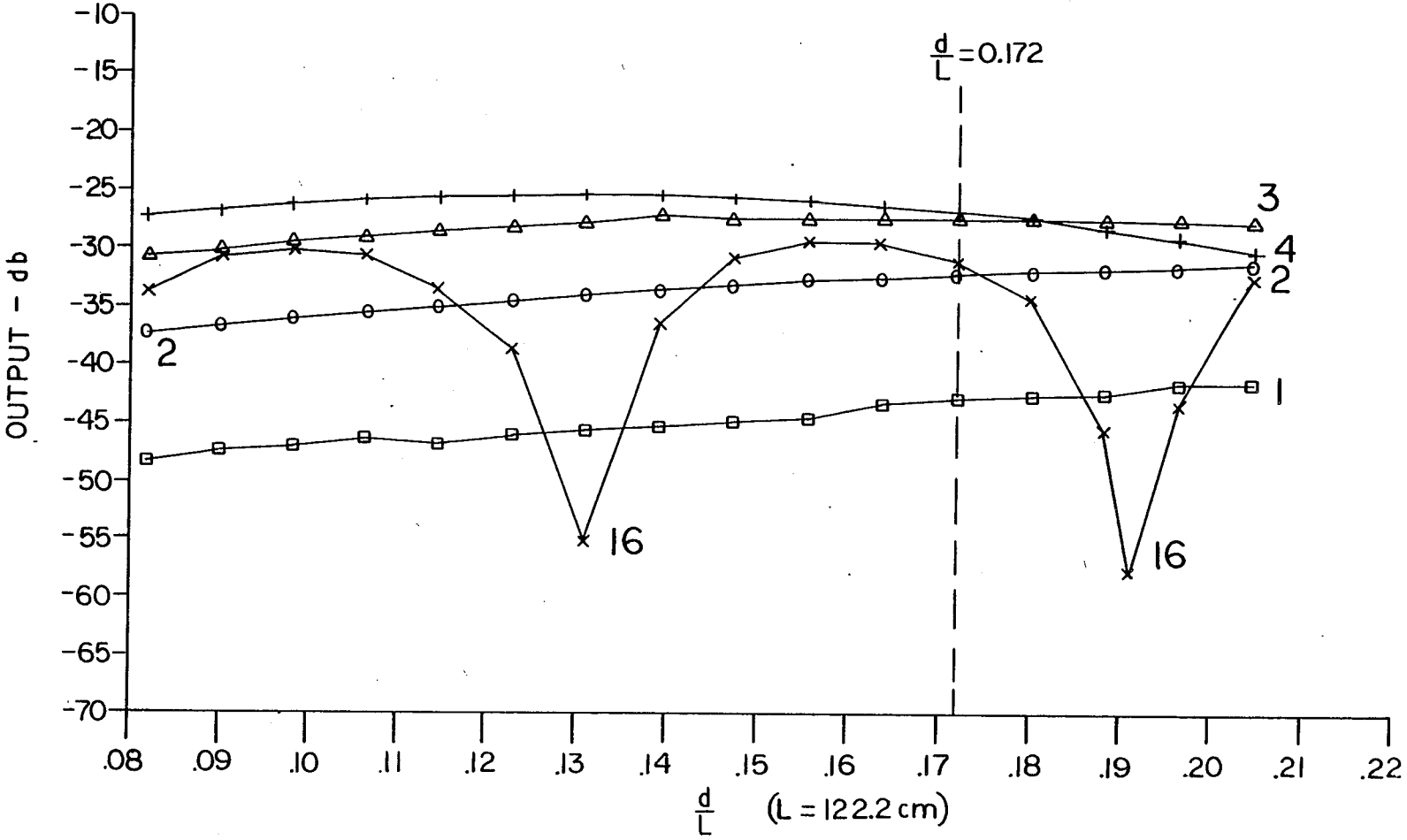
FIGS. 18 and 19 are graphs showing the variation of the relative amplitude of paritals 1 through 9 and 16 as a function of d/L for the string of FIG. 12.
Figure 19:
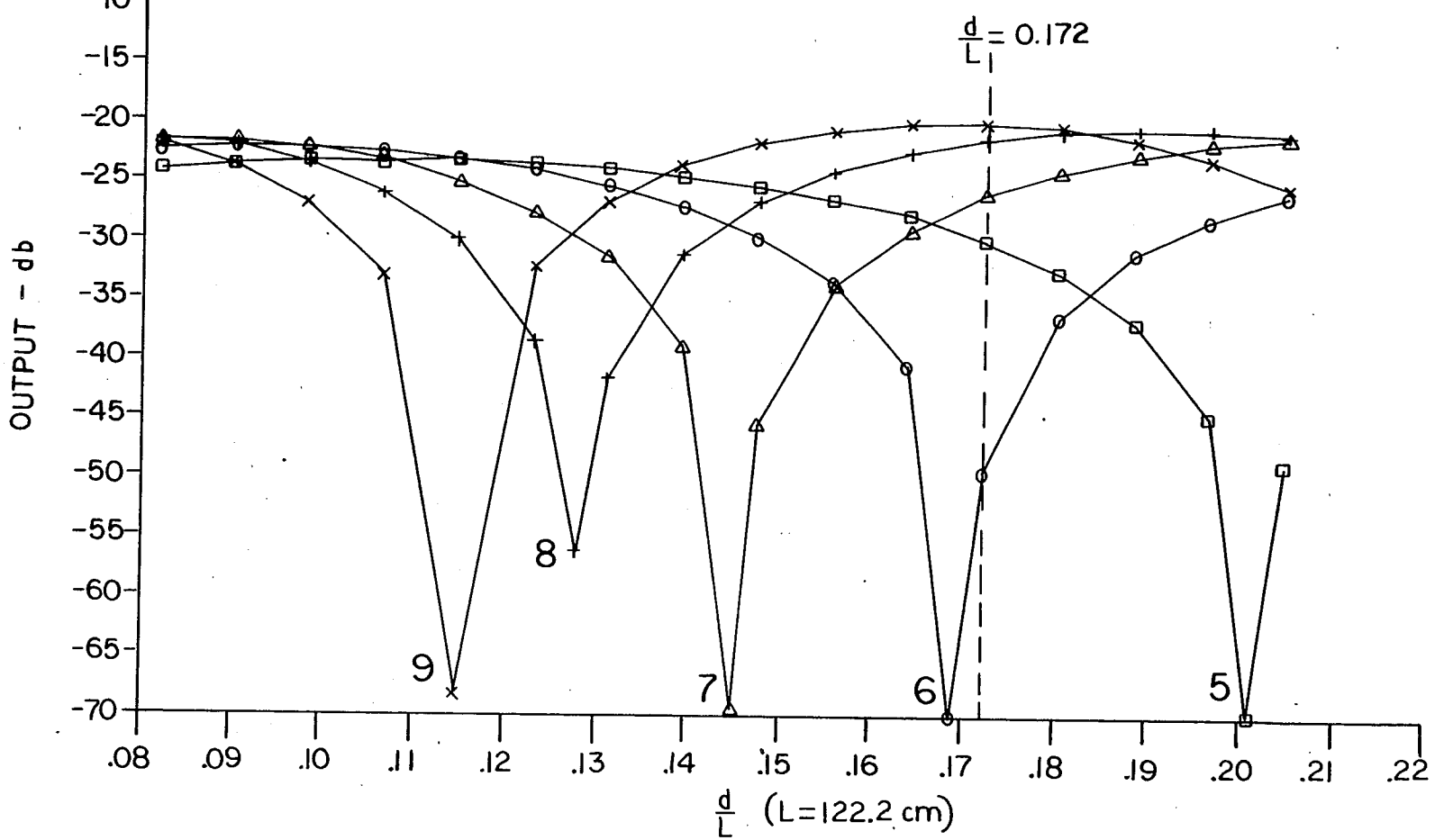
Figure 20:
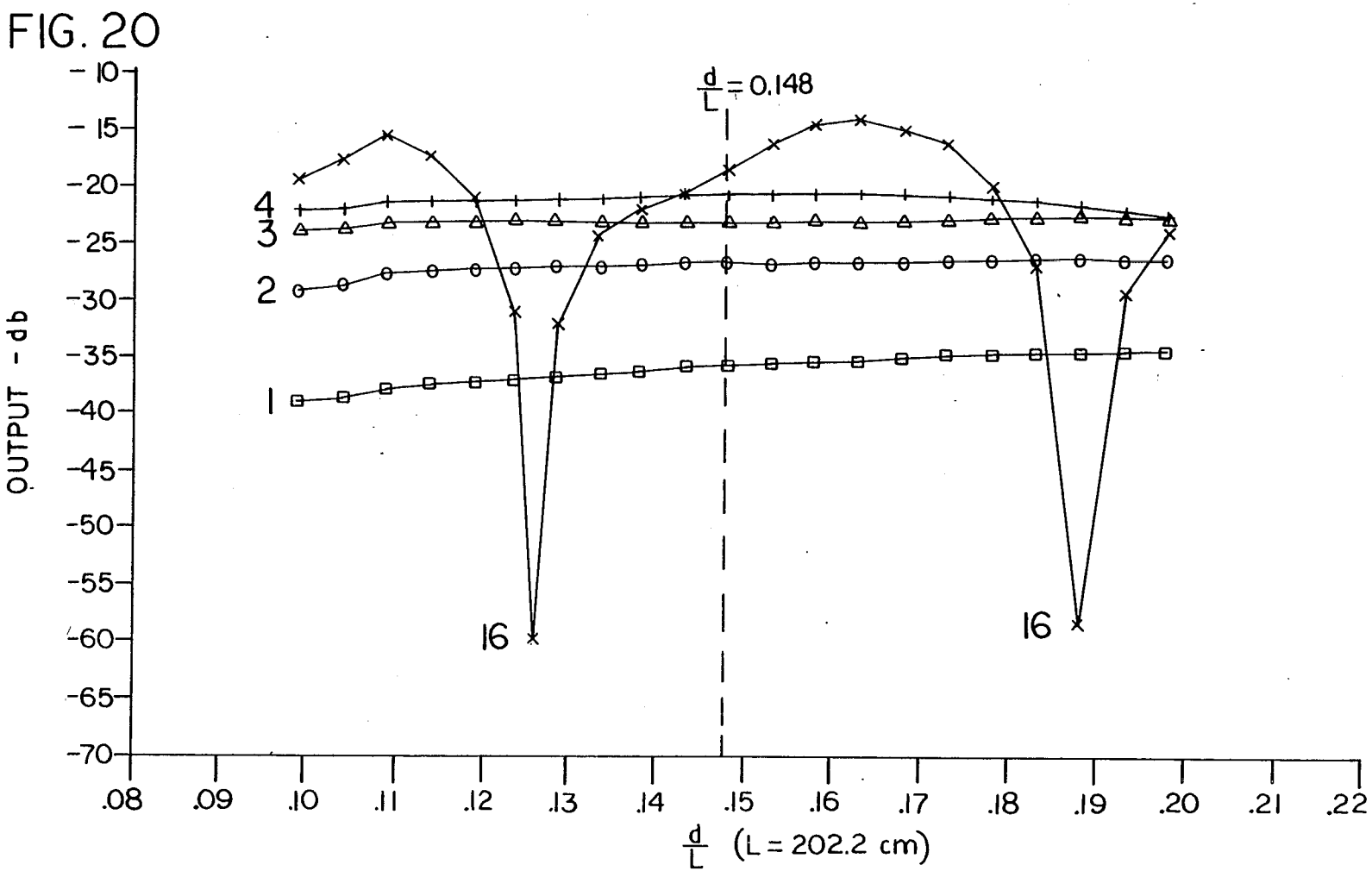
FIGS. 20 and 21 are graphs showing the variation of the relative amplitude of partials 1 through 9 and 16 as a function of d/L for the string of FIG. 13.
Figure 21:
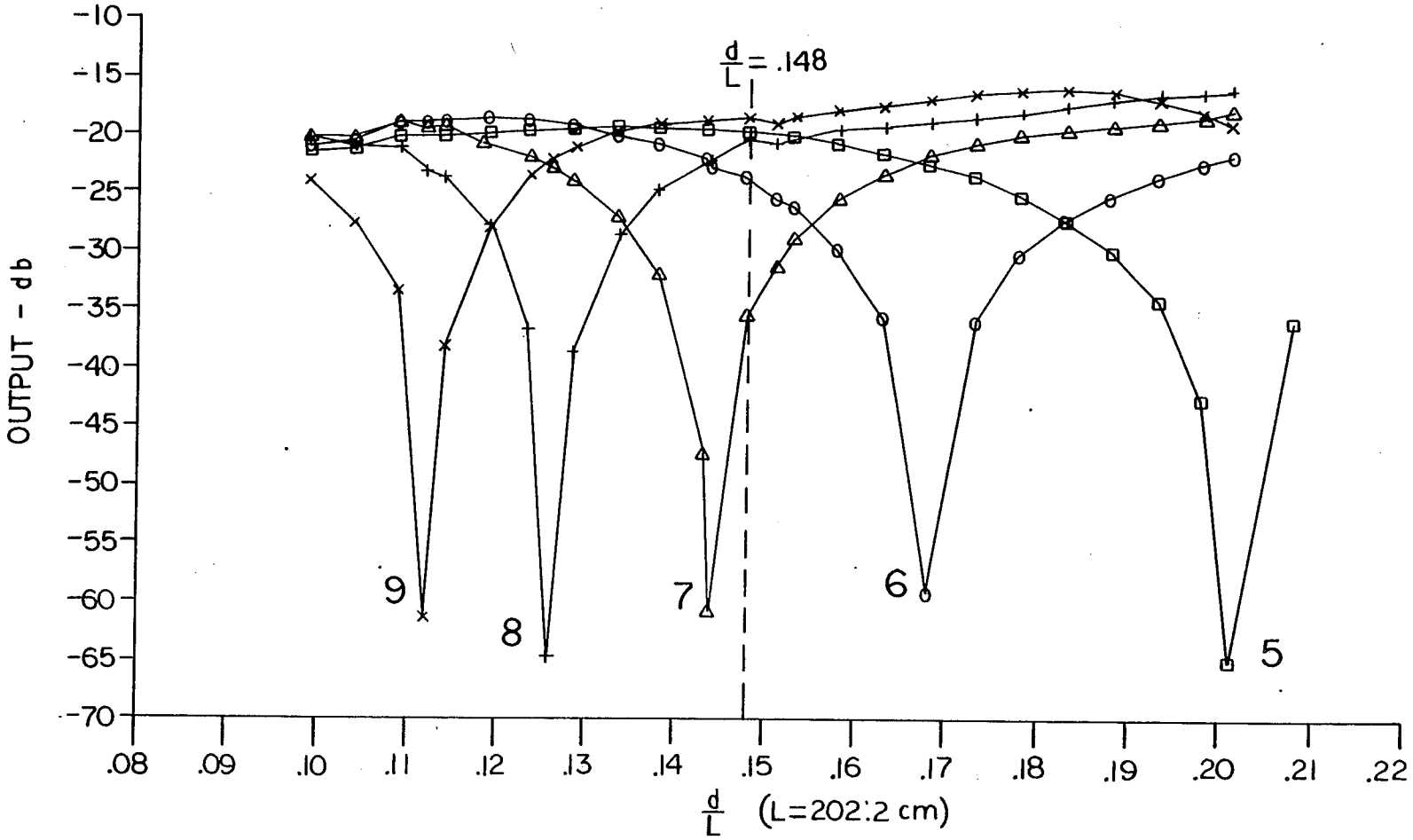

FIG. 13 shows the spectrum at "optimum" d/L of another string, in this case a string of 202.2 cm (179.6 inches) tuned to a fundamental frequency of 41.203 Hz. The corresponding value of d was 30 cm, giving d/L=0.148. This string was designed for note eight of a large grand piano. A comparison of this "optimum" spectrum with those for the previous three strings shows that the spectrum of FIG. 13 appears distinctly different from the others in respect to the shape of the envelope of its partials. But again, the optimum d/L was found to be larger than that of the prior art. Those familiar with analysis of piano tones will be aware that the spectrum of a piano tone does not remain constant as a function of time. The partials of a piano tone can and generally do die away at different rates. Therefore, a spectrum graph can only represent the relative amplitudes of the partials as they existed at one particular time. All of the graphs shown here represent the amplitude of the partials at and around the time of onset of the tone —that is, just after the string was struck.

FIGS. 14, 15, 16, 17, 18, 19, 20 and 21 are graphs showing the variation of the relative amplitude of partials 1 through 9 as well as that of partial 16 as a function of the value of d/L for each of the strings discussed above (i.e. the strings of FIGS. 6–10, 11, 12 and 13).

Included on each of these graphs is a vertical line representing that value of d/L which was found to be "optimum" for that string. It will be seen that the amplitude of the first three partials increases with increasing d/L throughout the range plotted. This means that the sound output of a piano at these frequencies would become correspondingly greater with an increase in d/L within this range. It will be noticed that the amplitude of partial four also gradually increases to some maximum value as d/L increases, but that for values of d/L larger than about 0.15 to 0.17, partial four decreases in amplitude. The fifth and higher numbered partials all fluctuate widely in amplitude within the tested range of variation of d/L. It will be observed that amplitude minima occur for a partial when the value of d/L is equal to or very nearly equal to L/n, if n is the number of the partial.

Table 1 lists the characteristics of the strings discussed above, including L, d, d/L for optimum tone, the wire sizes used to make each string, and a number giving the inharmonicity of the 16th partial in cents. (Note: The "cent" is a unit in common use to express small differences in the tuning of musical instruments. One cent=1/100 of a semitone. In equal temperament, a system of tuning used for all contemporary pianos, a semitone, which is the frequency interval between the tones produced by two adjacent piano keys, has a frequency ratio equal to the twelfth root of 2, or approximately 1.05946 . . . ). Table 1 shows the values of inharmonicity for each of the strings, from which it can be seen that those strings tuned to the same fundamental frequency which have different speaking lengths also have different values of inharmonicity, the shorter the string, the greater the inharmonicity. An increase of inharmonicity implies, of course, that not just the 16 th partial but all of the partials except the first (which is assumed to be tuned to the same fundamental frequency in all cases) will have a higher frequency than would be the case for a string of lower inharmonicity.

It is believed that differences in the amount of inharmonicity are responsible for the fact that shorter strings, with their partials of higher frequency, require larger values of d/L to give "optimum" tone than longer strings do. In accounting for this it is useful to understand that increasing the value of d/L by moving the striking point of the hammer to a position farther out along the string has the effect of shifting to lower frequencies all of the amplitude minima shown on the spectrum graphs. Conversely, moving the hammer striking point to obtain a smaller value of d/L will cause all of the amplitude minima to shift to higher frequencies. Because of this, it is believed, an increase in inharmonicity can be compensated for (in terms of the d/L setting for "optimum" tone) by moving the striking point of the hammer farther out along the string. When an increase of inharmonicity moves the partials to a higher frequency, an increase in d/L apparently can counteract this by moving both the amplitude minima and the amplitude maxima to lower frequencies. In effect, these two changes seem to compensate, one for the other, by shifting components of the string spectrum in opposite directions along the frequency axis. It should be noted well that there is a distinct difference between the two effects: shifting the striking point of the hammer has the effect of moving the entire envelope of the partials up or down in frequency without changing the nominal frequency of any of the partials, while a change of inharmonicity shifts the frequencies of the partials, in effect spreading them farther apart or compressing them, frequency-wise, without a major change in the shape of their envelope.

Table 2 shows the results of one embodiment of this invention. Table 2 lists the values of L and d/L that were used according to the teachings of the invention for scaling the strings of 32 notes of the bass section of an upright piano of medium size. Instruments built according to this design have exhibited excellent tone quality in all parts of the scale, but especially in the low bass region. In comparisons with other contemporary instruments of similar size having d/L restricted to the conventional prior art 1/7 to 1/9 range, the design summarized in Table 2 gave a quality of bass tone judged to be distinctly different from and preferable to that of the conventional instruments. It may be noted that the first 16 notes employ values of d/L in excess of 1/7. It has been found that application of the invention produces the most useful improvement in the low bass region of the scale of an instrument.

In this embodiment the optimum value of d/L was determined subjectively using individually mounted test strings of the appropriate length and tuned to the appropriate frequency. The first 16 notes of the bass range had an optimum d/L in excess of 1/7. The d/L for the remaining notes 17–32 were varied incrementally. It is within the scope of the invention to scale notes 1–32 of the bass section using the d/L values shown in Table 2. Alternatively, it is within the scope of the present invention to scale notes 1–16 as shown in Table 2, and select an appropriate d/L value from the range of 1/7 to 1/9 for the remainder 17–32 of the notes. As yet another alternative, the d/L value of notes 17–32 can be individually optimized.

Table 3 lists L and optimum d/L values for the eight longest strings of a large grand piano that also embodies the principles of this invention. This was accomplished in the same subjective manner described above. It should be noted that the values of d/L found to be optimum for this instrument are different from those shown in Table 2 for the upright piano of medium size. As has been pointed out, the dependence of the "optimum" value for d/L upon string and scale design parameters such as length, inharmonicity, etc., is a characteristic of pianos designed according to the invention.

The judgment of the tone quality of a piano is subjective. The measurement of the physical characteristics of a sound should be objective. Graphs of the measured spectra of piano tones have been included here because of the difficulty of describing tone quality or timbre. It is believed that it probably is impossible to describe adequately or to define fully with words the particular quality of tone that is obtained when this invention is applied. It can be said, however, that all listeners to whom the tonal effect has been demonstrated have agreed that a real and clearly audible change in quality occurs when d/L is adjusted within the range herein defined as "optimum". The effect obtained by varying d/L might be likened to a variation in the apparent pitch of the tone. The apparent pitch can range over several semitones as d/L is varied. The "optimum" setting described is that one which seems to most listeners to produce the most pleasing result. At an early stage of this work it was believed that the "optimum" d/L might turn out to be one which gave the greatest amplitudes of either the 8th or the 16th partials of the tone, but, as will be seen from the graphs of FIGS. 14 through 21, this appears not necessarily to be the case, although the 8th and 16th partials are found to be near to their maximum values at the "optimum" settings of d/L. In every case the graphs of FIGS. 14 through 21 showed that the "optimum" d/L had a value greater than 1/7 but less than 1/5.

Persons familar with the acoustical characteristics of pianos will know that the sound output of mechano-acoustic pianos decreases at the low audio frequencies. This occurs because of a reduction in the acoustical efficiency of the soundboard system. In general, the sound output of a piano decreases rapidly at frequencies below the first soundboard vibrational mode. For a large, fully assembled grand piano, for example, the frequency of the first soundboard mode may be of the order of 60–70 Hz. For smaller instruments the first mode may occur at a somewhat greater frequency. Some instruments may have little useful sound output at frequencies below 100 Hz. It follows that there will be much less sound output at the fundamental frequencies of the lowest notes on the standard piano keyboard than there will be at the frequencies of some of the upper partials of these notes. As was previously noted, the fundamental frequency of the lowest note on the standard keyboard is 27.5 Hz. In general, neither the fundamental nor even the second partial of this note will be radiated efficiently because, in most cases, both frequencies will be below the first soundboard mode. In fact, in many instruments, very little sound energy is radiated at the fundamental frequencies of the notes within the entire lowest octave. It is therefore important to consider the effective radiation at the second and higher partials, as well as the relation between this and the hammer striking distance.

FIGS. 14, 16, 18, and 20 show that for d/L=0.2 or less, the larger the value of d/L the greater the output from the string (and hence from the piano) for partials 1 through 3. The same is true for partial 4, except that its amplitude may decline slightly for d/L values greater than 0.15. In designs which employ the present invention, therefore, the first four partials normally will contain more energy than would be the case for conventional designs, and consequently the resulting tone will have increased low-bass output. However, as FIGS. 15, 17, 19 and 21 show, the strength of the 5th and 6th partials generally decreases as d/L is increased. In some cases this may result subjectively in somewhat less apparent "fullness" of tone, even though the overall tone quality may be judged to be better and the low-bass output increased. If this occurs, it will happen only in the extreme low bass of an instrument—that is, in only the last few notes of the keyboard. In such an instance it might be desirable to ∂taper out" the augmented d/L mode using a method of scaling which will not produce an undesirable discontinuity in tone quality. A method of accomplishing this has been discovered and is set forth herein. The method is to change d/L (i.e. make D/L smaller) from note to note toward the low frequency end of the bass bridge in discrete steps of the correct size so as to alter the subjective d/L - dependent pitch in 100 cent increments. The following will clarify this concept.

It was mentioned previously that moving the striking point of a piano hammer incrementally along the length of a given piano string within the low bass region, while repeatedly striking the string with the hammer, can produce the effect of an incremental change in the apparent pitch of the string. It is possible, in effect, to "play a scale" on a given string by changing only the hammer striking distance, d. By "playing a scale" it is meant that d can be changed in increments such that the apparent pitch change from one increment to the next seems to be the same as that from one note to some other note on the piano keyboard. It must be made quite clear here that we do not wish to imply that there is a significant physically measurable frequency change that occurs in the vibration of the string due to movement of the hammer striking point. What does change, as the graphs and curves of FIGS. 6 through 21 show, is the amplitude of the partials. For a particular string, each setting of d has associated with it a characteristic envelope representing the amplitude of the partials for that particular condition. This envelope or "formant" might be considered to be the result of passing a set of partials of uniform amplitude through a filter which alters the partials in a certain way. Each different envelope gives a distinctive quality or timbre to the resulting piano tone.

As has already been noted, adjacent keyboard tones of the equally tempered scale are by design related to each other by a frequency ratio equal to the twelfth root of 2, ($2^{1/12}=1.05946\ldots$). This frequency ratio is called a semi-tone, and for finer reckoning it is often divided into 100 smaller parts called "cents" (100 cents=one semi-tone). It has been found that a 100-cent change in apparent pitch of the d/L formant can be realized by a change in d/L of approximately the twelfth root of 2. For example, if for a particular low-bass string d/L has been chosen and set to the "optimum" value X (within the range greater than 1/7 but less than 1/5, as described previously) it has been found that setting a new d/L having a value (X)/(1.05946 . . . ) will increase the apparent pitch by approximately 100 cents. A 200-cent pitch increase can be achieved by setting d/L equal to $(X)/(1.05946\ldots)^2$.

If it is desired to have a rapid but smooth transition from a first group of strings in the bass section having d/L greater than 1/7 (according to the teachings of this invention) to a second group of strings in the bass section having a conventional d/L in the range less than 1/7, it has found that an acceptable transition without undesirable discontinuities in tone quality between adjacent notes may be achieved if d/L is changed (i.e. made smaller) from note-to-note toward the high frequency end of the bass bridge by a factor of the twelfth root of 2 as just described. This would normally involve adjustment of d/L for about one to about 3 notes at the upper end of the first group of strings. That the subjective d/L pitch can be tuned in steps approximating 100 cents as a result of altering d/L by a factor equal to the twelfth root of two was an unexpected finding. This is discussed below.

That it is possible to affect in any way the apparent pitch of a piano tone by changing the value of d without changing the frequencies of any of the partials is of course due to the change in the relative amplitude of the partials as d is varied. At the d/L setting found to be "optimum" according to this invention, the d/L formant sounds most in tune with the overall string tone. At this optimum setting (which occurs for d/L greater than 1/7, as explained previously) the d/L formant sounds as though it has a multiple-octave relationship to the fundamental frequency of the string. This is believed to be due to the 8th and 16th partials, which have frequencies approximately three and four octaves, respectively, above the fundamental. As FIGS. 10 through 21 show, both the 8th and 16 partials are near to an amplitude maximum when d/L is "optimum." The exact value of d/L corresponding to the "optimum" setting varies with the design of the string because of such factors as inharmonicity. However, an average representative "optimum" value for d/L might be 0.16. (FIGS. 14–21 show "optimum" d/L values ranging from 0.148–0.172). It will be observed—see for example FIGS. 16 and 17—that the amplitudes of partials 8 and 16 cycle through two or more maxima within the range plotted on the curves, one of these being in the region near to or fairly near to the d/L value for "optimum" tone. As d/L is reduced from the "optimum" value it will be seen that both the 8th and 16th partials have minimum values at d/L of about 0.125. For d/L smaller than 0.125, both partials increase in amplitude, reaching maxima when d/L is 0.08–0.09. When d/L is approximately 0.08, it has been found, a tonal condition somewhat similar to "optimum" occurs, at which the d/L formant again seems to have a multiple-octave relationship to the fundamental string frequency. It is significant that this condition occurs for a d/L value approximately one-half that for "optimum" tone. If d/L is varied within this 2:1 range, the pitch of the d/L formant also seems to vary through approximately a one octave (2:1) range. The changing amplitude of the various partials as d/L is changed within the 2:1 range produces the effect of changing pitch. What is heard is a changing emphasis of one or more of the partials in relation to the remaining partials.

Figure 22:
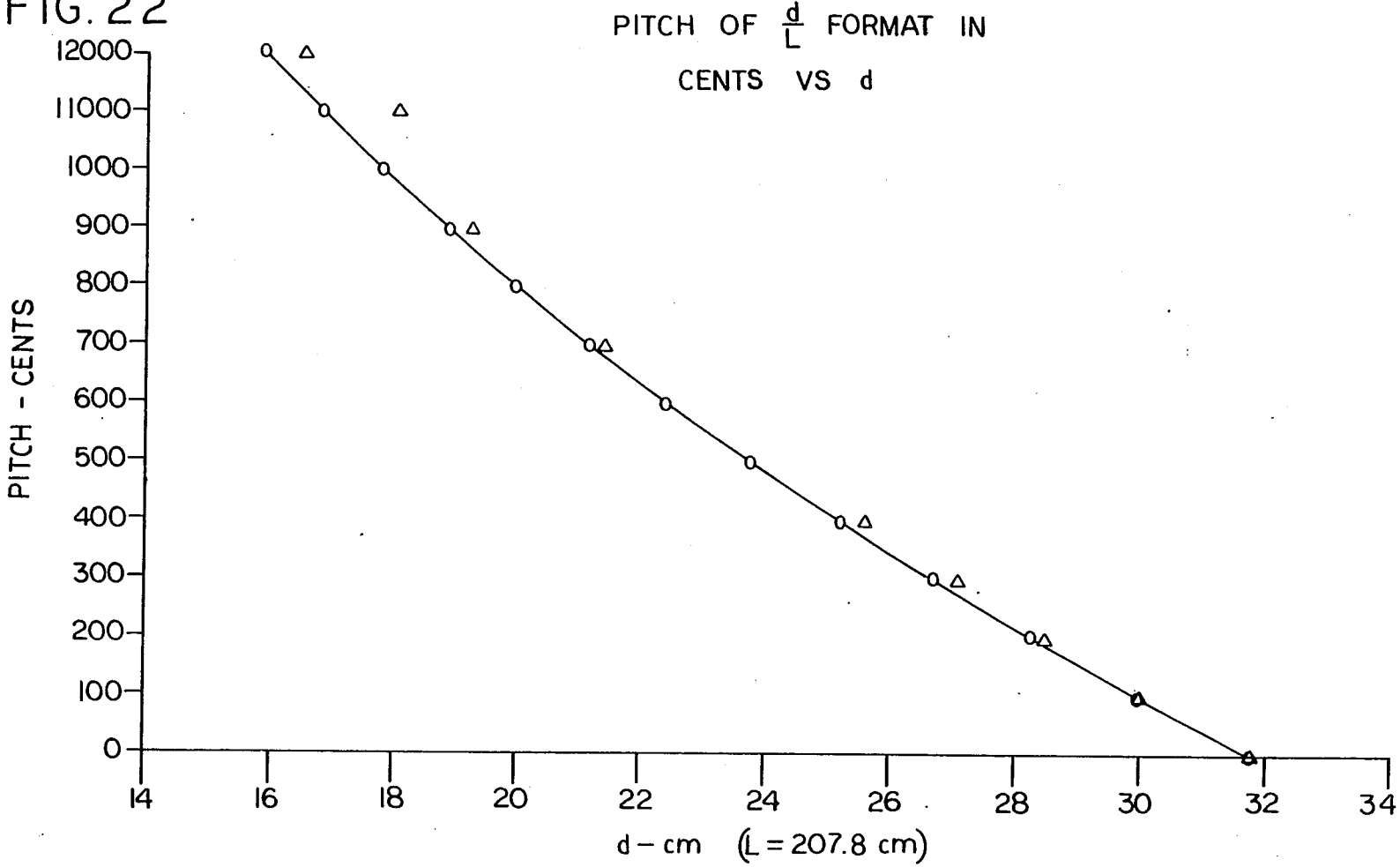
FIG. 22 is a graph illustrating both subjective and calculated pitch of the d/L formant in cents v. striking distance (d) in cm.

Table 4 and FIG. 22 give experimental data which show that the apparent pitch of the d/L formant (the pitch which appears to change as the striking point of a piano hammer is moved along a string) actually changes by a factor of approximately $2^{1/12}$ when d/L itself is changed by that same factor. These data were obtained by testing in a piano with a string having L=207.8 cm long, made with 0.063" diameter core wire wrapped helically with 0.051" diameter copper loading wire. First, the "optimum" setting of d was found by listening to be 31.75 cm (giving d/L=0.153). Next the value of d was changed so that the pitch of the d/L formant was judged to change successively by factors of $2^{1/12}$ or 100 cents. The corresponding values of d were measured and recorded as "Actual d" in Table 4, and plotted as the triangular points in FIG. 22. Finally, a set of "Calculated d" points was figured at 100-cent intervals, according to the formula shown in Table 4, and plotted in FIG. 22 as the solid curve. It may be seen that the triangular points follow very closely the solid curve over most of the 1200-cent range shown in the figure, thus supporting the conclusion that a $2^{1/12}$ change in d or d/L, under the conditions stated, will produce a change of d/L formant pitch of approximately 100 cents.

Modifications may be made in the invention without departing from the spirit of it.

TABLE 1

| String No. | Nom. Fund Freq. Hz | L CM | d CM | d/L | Inhar Par 16 ¢ | Steel Core Wire (In) | Copper Wrap 1 (In) | Copper Wrap 2 (In) |
|---|---|---|---|---|---|---|---|---|
| 1 | 27.5 | 210.3 | 33.2 | .158 | 25.7 | .063 | .058 | |
| 2 | 27.5 | 137.2 | 22.5 | .164 | 47.4 | .049 | .0258 | .058 |
| 3 | 27.5 | 122.2 | 21.0 | .172 | 87.2 | .053 | .0348 | .0625 |
| 4 | 41.203 | 202.2 | 30.0 | .148 | 17.2 | .057 | .0348 | |

TABLE 2

| Note No. | L Inches | d Inches | d/L |
|---|---|---|---|
| 1 | 54.00 | 8.86 | .164 |
| 2 | 53.76 | 8.74 | .163 |
| 3 | 53.49 | 8.63 | .161 |
| 4 | 53.21 | 8.51 | .160 |
| 5 | 52.91 | 8.39 | .159 |
| 6 | 52.60 | 8.27 | .157 |
| 7 | 52.34 | 8.16 | .156 |
| 8 | 51.98 | 8.03 | .154 |
| 9 | 51.65 | 7.91 | .153 |
| 10 | 51.30 | 7.79 | .152 |
| 11 | 50.94 | 7.66 | .150 |
| 12 | 50.56 | 7.53 | .149 |
| 13 | 50.19 | 7.41 | .148 |
| 14 | 49.81 | 7.29 | .146 |
| 15 | 49.31 | 7.15 | .145 |
| 16 | 48.99 | 7.04 | .144 |
| 17 | 48.57 | 6.91 | .142 |
| 18 | 48.14 | 6.78 | .141 |
| 19 | 47.71 | 6.66 | .140 |
| 20 | 47.26 | 6.54 | .138 |
| 21 | 46.80 | 6.41 | .137 |
| 22 | 46.33 | 6.28 | .135 |
| 23 | 45.85 | 6.15 | .134 |
| 24 | 45.36 | 6.02 | .133 |
| 25 | 44.87 | 5.90 | .131 |
| 26 | 44.36 | 5.77 | .130 |
| 27 | 43.84 | 5.65 | .129 |
| 28 | 43.32 | 5.52 | .127 |
| 29 | 42.77 | 5.39 | .126 |
| 30 | 42.24 | 5.27 | .125 |
| 31 | 41.68 | 5.14 | .123 |
| 32 | 41.12 | 5.02 | .122 |

TABLE 3

| String No. | L (In) | d/L | Core (In) | Copper Wrap 1 (In) | Copper Wrap 2 (In) |
|---|---|---|---|---|---|
| 1 | 82.8 | .158 | .063 | .058 | |
| 2 | 82.45 | .156 | .063 | .054 | |
| 3 | 81.82 | .152 | .063 | .051 | |
| 4 | 81.51 | .151 | .063 | .014 | .0317 |
| 5 | 81.11 | .150 | .063 | .041 | |
| 6 | 80.65 | .149 | .061 | .041 | |
| 7 | 80.11 | .148 | .057 | .0379 | |
| 8 | 79.60 | .147 | .057 | .0348 | |

TABLE 4

COMPARISON OF MEASURED AND CALCULATED "d" FOR EQUALLY TEMPERED d/L FORMANT

| Interval n cents | Calculated d cm | Actual d cm |
|---|---|---|
| 0 | 31.75 | 31.75 |
| 100 | 29.97 | 30.02 |
| 200 | 28.29 | 28.50 |
| 300 | 26.69 | 27.08 |
| 400 | 25.20 | 25.58 |
| 500 | 23.77 | — |
| 600 | 22.43 | — |
| 700 | 21.18 | 21.41 |
| 800 | 19.99 | — |
| 900 | 18.87 | 19.23 |
| 1000 | 17.80 | — |
| 1100 | 16.81 | 18.03 |
| 1200 | 15.88 | 16.51 |

L = 207.8 cm
Frequency = 30.868 Hz
Core Diam. = .063"

TABLE 4-continued

| COMPARISON OF MEASURED AND CALCULATED "d" FOR EQUALLY TEMPERED d/L FORMANT | | |
|---|---|---|
| Interval n cents | Calculated d cm | Actual d cm |
| Wrap Diam. = .051" | | |

Note:
(1) Calculated d gives values based on d (optimum) = 31.75 cm and $d_n = \frac{d_o}{2^n/1200}$
(2) "Optimum" d for the string used was 31.75 cm and L was 207.8 cm.
(3) Actual d was measured at aurally correct positions (best estimates).

What is claimed is:

1. A mechano-acoustic piano in which the tone-generating elements are struck strings made of steel core wire stretched under tension, said strings being either plain or wrapped with one or two layers of covering wire, each said layer of covering wire encircling the said core wire in the form of a helix, said piano having a string plate, a soundboard, and treble and bass bridges on said soundboard, each string terminating vibrationally near one of its ends on said string plate and terminating vibrationally near the other of its ends on one of said treble and bass bridges, each string having a speaking length L and a hammer striking distance d, said piano having at least 88 notes, a keyboard key for each note, 32 of said keyboard keys producing tones having the smallest fundamental frequencies in said piano, a hammer for each note, and a compass spanning at least a frequency range from the note AO=27.5 Hz. to the note C8=4186 Hz., some at least of said strings corresponding to said 32 keyboard keys that produce those piano tones having the smallest fundamental frequencies are struck by their corresponding hammers at hammer striking distances d greater than one-seventh and less than one-fifth of their speaking lengths L.

2. The piano claimed in claim 1 wherein each of said strings having hammer striking distances greater than 1/7 and less than 1/5 of its respective speaking length has an independently chosen d/L ratio for its respective key so that said ratio will be optimum to produce a preferred quality of tone.

3. The piano claimed in claim 1 wherein the numerical vaoue of a ratio d/L, obtained by dividing said hammer striking distance d by said speaking length L varies incrementally from note-to-note and key-to-key for said strings having hammer striking distances greater than 1/7 and less than 1/5 of their speaking lengths.

4. The piano cliamed in claim 1 wherein the remaining number of said strings associated with the remaining number of said 32 keys are struck by their respective hammers at hammer striking distances between 1/7 and 1/9 of their respective speaking lengths.

5. The piano claimed in claim 4 wherein said remaining number of said strings have numerical values of a ratio d/L which vary incrementally from note-to-note, and key-to-key.

6. The piano claimed in claim 4 wherein said remaining number of strings have independently chosen numerical values for a d/L ratio for the strings corresponding to each of said remaining keys whereby said ratio will be optimum.

7. The piano claimed in claim 4 wherein said remaining number of strings corresponding to said remaining keys have independently chosen numerical values for a d/L ratio note-to-note and key-by-key whereby said ratio will be optimum note-to-note and key-to-key to produce a preferred tone quality.

8. The piano claimed in claim 4 wherein the numerical value of a d/L ratio remains constant note-to-note and key-by-key for more than one-half of said remaining strings.

9. The piano claimed in claim 4 wherein for each of those strings associated with one or more smaller groups of from one to four adjacent keys within said group of 32 keys, the value of a d/L ratio is changed incrementally from key-to-key by multiplying said value by a factor of 2 to the 1/12 power to increase said value and by dividing said value by a factor of 2 to the 1/12 power to decrease said value as required.

10. The piano claimed in claim 4 wherein those of said strings corresponding to said 32 notes which have vibrational terminations on said bass bridge have numerical values of a d/L ratio which vary incrementally from note-to-note and from key-to-key.

11. A mechano-acoustic piano in which the tone-generating elements are struck strings made of steel core wire stretched under tension, said strings being either plain or wrapped with one or two layers of covering wire, each said layer of covering wire encircling the said core wire in the form of a helix, said piano having a string plate, a soundboard, and treble and bass bridges on said soundboard, each string terminating vibrationally near one of its ends on said string plate and terminating vibrationally near the other of its ends on one of said treble and bass bridges, each string having a speaking length L and a hammer striking distance d, said piano having at least 88 notes, a keyboard key for each note, a hammer for each note, and a compass spanning at least a frequency range from the note AO=27.5 Hz. to the note C8=4186 Hz., the strings corresponding to the 32 keyboard keys that produce those notes having the smallest fundamental frequencies having vibrational terminations on said bass bridge and have speaking lengths and hammer striking distances as indicated below wherein the keys and notes are consecutively numbered from that note having the smallest fundamental frequency designated note 1:

| Note No. | L Inches | d Inches | d/L |
|---|---|---|---|
| 1 | 54.00 | 8.86 | .164 |
| 2 | 53.76 | 8.74 | .163 |
| 3 | 53.49 | 8.63 | .161 |
| 4 | 53.21 | 8.51 | .160 |
| 5 | 52.91 | 8.39 | .159 |
| 6 | 52.60 | 8.27 | .157 |
| 7 | 52.34 | 8.16 | .156 |
| 8 | 51.98 | 8.03 | .154 |
| 9 | 51.65 | 7.91 | .153 |
| 10 | 51.30 | 7.79 | .152 |
| 11 | 50.94 | 7.66 | .150 |
| 12 | 50.56 | 7.53 | .149 |
| 13 | 50.19 | 7.41 | .148 |
| 14 | 49.81 | 7.29 | .146 |
| 15 | 49.31 | 7.15 | .145 |
| 16 | 48.99 | 7.04 | .144 |
| 17 | 48.57 | 6.91 | .142 |
| 18 | 48.14 | 6.78 | .141 |
| 19 | 47.71 | 6.66 | .140 |
| 20 | 47.26 | 6.54 | .138 |
| 21 | 46.80 | 6.41 | .137 |
| 22 | 46.33 | 6.28 | .135 |
| 23 | 45.85 | 6.15 | .134 |
| 24 | 45.36 | 6.02 | .133 |
| 25 | 44.87 | 5.90 | .131 |
| 26 | 44.36 | 5.77 | .130 |
| 27 | 43.84 | 5.65 | .129 |

-continued

| Note No. | L Inches | d Inches | d/L |
|---|---|---|---|
| 28 | 43.32 | 5.52 | .127 |
| 29 | 42.77 | 5.39 | .126 |
| 30 | 42.24 | 5.27 | .125 |
| 31 | 41.68 | 5.14 | .123 |
| 32 | 41.12 | 5.02 | .122 |

whereby to improve the tone quality of said last mentioned strings.

12. A mechano-acoustic piano in which the tone-generating elements are struck strings made of steel core wire stretched under tension, said strings being either plain or wrapped with one or more layers of covering wire, each said layer of covering wire encircling the said core wire in the form of a multi-turn helix, said piano having a string plate, a soundboard and treble and bass bridges on said soundboard, each string terminating vibrationally near one of its ends on said string plate and terminating vibrationally near its other end on one of said treble and bass bridges, each string having a speaking length L and a hammer striking distance d, said piano having at least 88 notes and a key for each note, a hammer for each note and a compass spanning at least a frequency range from the note AO=27.5 Hz. to the note C8=4186 Hz., at least some of the said strings have hammer striking distances greater than 1/7 and less than 1/5 of their respective speaking lengths, said strings having hammer striking distances greater than 1/7 and less than 1/5 of their respective speaking lengths have vibrational terminations on said bass bridge.

* * * * *